US009523931B2

(12) United States Patent
Kojima et al.

(10) Patent No.: US 9,523,931 B2
(45) Date of Patent: Dec. 20, 2016

(54) TONER, DEVELOPER AND IMAGE FORMING APPARATUS

(71) Applicants: Satoshi Kojima, Shizuoka (JP); Junichi Awamura, Shizuoka (JP); Tsuneyasu Nagatomo, Shizuoka (JP); Shingo Sakashita, Shizuoka (JP); Tomoki Murayama, Kanagawa (JP); Masaya Fukuda, Kanagawa (JP)

(72) Inventors: Satoshi Kojima, Shizuoka (JP); Junichi Awamura, Shizuoka (JP); Tsuneyasu Nagatomo, Shizuoka (JP); Shingo Sakashita, Shizuoka (JP); Tomoki Murayama, Kanagawa (JP); Masaya Fukuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/168,172

(22) Filed: Jan. 30, 2014

(65) Prior Publication Data

US 2014/0220485 A1 Aug. 7, 2014

(30) Foreign Application Priority Data

Feb. 5, 2013 (JP) ..... 2013-020424

(51) Int. Cl.

| | |
|---|---|
| ***G03G 9/00*** | (2006.01) |
| ***G03G 9/08*** | (2006.01) |
| ***G03G 9/087*** | (2006.01) |
| ***G03G 9/097*** | (2006.01) |

(52) U.S. Cl.

CPC ..... *G03G 9/0804* (2013.01); *G03G 9/08755* (2013.01); *G03G 9/08795* (2013.01); *G03G 9/08797* (2013.01); *G03G 9/09725* (2013.01)

(58) Field of Classification Search

CPC ..... G03G 9/09725; G03G 9/08755; G03G 9/09708

USPC ..... 430/105, 108.7, 109.1, 123.51

See application file for complete search history.

(56) References Cited

U.S. PATENT DOCUMENTS

| | | | | |
|---|---|---|---|---|
| 2006/0240350 | A1* | 10/2006 | Shu et al. | 430/108.6 |
| 2007/0218386 | A1* | 9/2007 | Suzuki | G03G 9/0806 430/108.4 |
| 2010/0119255 | A1 | 5/2010 | Seshita et al. | |
| 2010/0183967 | A1 | 7/2010 | Sabu et al. | |
| 2010/0261112 | A1* | 10/2010 | Aruga et al. | 430/105 |
| 2010/0310980 | A1 | 12/2010 | Sugimoto et al. | |
| 2010/0330489 | A1 | 12/2010 | Inoue et al. | |
| 2011/0003244 | A1 | 1/2011 | Inoue et al. | |
| 2011/0065036 | A1 | 3/2011 | Inoue et al. | |
| 2011/0076607 | A1 | 3/2011 | Sugimoto et al. | |
| 2011/0104608 | A1 | 5/2011 | Nakajima et al. | |
| 2011/0124838 | A1 | 5/2011 | Kotsugai et al. | |
| 2011/0129773 | A1 | 6/2011 | Shu et al. | |
| 2011/0151372 | A1 | 6/2011 | Watanabe et al. | |
| 2011/0200928 | A1 | 8/2011 | Watanabe et al. | |
| 2011/0200929 | A1 | 8/2011 | Karato et al. | |
| 2011/0223532 | A1 | 9/2011 | Sugimoto et al. | |
| 2011/0262853 | A1 | 10/2011 | Watanabe et al. | |
| 2011/0281213 | A1 | 11/2011 | Sakashita et al. | |
| 2011/0294058 | A1 | 12/2011 | Shiba et al. | |
| 2011/0305986 | A1 | 12/2011 | Ogawa et al. | |
| 2011/0318053 | A1 | 12/2011 | Yamashita et al. | |
| 2011/0319647 | A1* | 12/2011 | Yoshikawa | C01B 33/141 556/478 |
| 2012/0021347 | A1 | 1/2012 | Shimota et al. | |
| 2012/0082926 | A1 | 4/2012 | Suzuki et al. | |
| 2012/0115079 | A1* | 5/2012 | Ikeda | B82Y 30/00 430/108.7 |
| 2012/0202147 | A1 | 8/2012 | Suzuki et al. | |
| 2012/0264043 | A1 | 10/2012 | Watanabe et al. | |
| 2012/0288791 | A1 | 11/2012 | Sakashita et al. | |
| 2013/0011779 | A1 | 1/2013 | Yamashita et al. | |
| 2013/0017480 | A1 | 1/2013 | Suzuki et al. | |
| 2013/0130171 | A1 | 5/2013 | Watanabe et al. | |
| 2013/0157183 | A1 | 6/2013 | Santo et al. | |
| 2013/0157184 | A1 | 6/2013 | Sugimoto et al. | |
| 2013/0157185 | A1 | 6/2013 | Sakashita et al. | |
| 2013/0196260 | A1 | 8/2013 | Yoshida et al. | |
| 2013/0196263 | A1 | 8/2013 | Asahina et al. | |
| 2013/0216944 | A1 | 8/2013 | Shiba et al. | |
| 2013/0236826 | A1 | 9/2013 | Makabe et al. | |
| 2013/0243488 | A1 | 9/2013 | Kojima et al. | |
| 2013/0244154 | A1 | 9/2013 | Yamamoto et al. | |
| 2013/0244155 | A1 | 9/2013 | Satoh et al. | |
| 2013/0244156 | A1 | 9/2013 | Kojima et al. | |
| 2013/0252158 | A1 | 9/2013 | Yamada et al. | |

FOREIGN PATENT DOCUMENTS

| | | |
|---|---|---|
| JP | 2002-278261 | 9/2002 |
| JP | 2006-39023 | 2/2006 |

(Continued)

OTHER PUBLICATIONS

Japanese Offer Forms issued Dec. 18, 2015 Patent Application No. 2013-020424 (with English translation).

*Primary Examiner* — Thorl Chea

(74) *Attorney, Agent, or Firm* — Oblon, McClelland, Maier & Neustadt, L.L.P.

(57) ABSTRACT

To provide a toner, which contains silica particles containing first silica particles, and second silica particles, wherein the toner is a toner produced by depositing the silica particles on surfaces of base particles, the first silica particles have an average primary particle diameter of 75 nm to 250 nm, the second silica particles have an average primary particle diameter of 10 nm to 50 nm, a mass ratio of the first silica particles to the base particles is 0.010 to 0.040, a mass ratio of the second silica particles to the base particles is 0.005 to 0.030, a liberation ratio of the silica particles from the toner by a ultrasonic vibration method is 5% by mass to 20% by mass, and an amount of particles having primary particle diameters of 30 nm or smaller in the silica particles librated from the toner by the ultrasonic vibration method is 20% by number or less.

14 Claims, 4 Drawing Sheets

(56) References Cited

FOREIGN PATENT DOCUMENTS

| | | |
|---|---|---|
| JP | 2006-154387 | 6/2006 |
| JP | 2006-323367 | 11/2006 |
| JP | 2011-002557 | 1/2011 |
| JP | 2013-064819 | 4/2013 |
| WO | 2013/137366 A1 | 9/2013 |

* cited by examiner

TONER, DEVELOPER AND IMAGE FORMING APPARATUS

BACKGROUND OF THE INVENTION

Field of the Invention

One embodiment of the present invention relates to a toner, a developer, and an image forming apparatus.

Description of the Related Art

An electric photographic image forming apparatus performs a charging step where an image forming region of a surface of a photoconductor is uniformly charged, an exposing step where writing is performed on the photoconductor, a developing step where a toner image is formed with a charged toner through frictions on the photoconductor, and a transferring step where the toner image on the photoconductor is transferred onto a recording medium directly, or via an intermediate transfer member, followed by fixing the toner image on the recording medium. Moreover, the toner remained on the photoconductor without being transferred to a printing sheet is scraped from the photoconductor by a cleaning step, to thereby be ready for a next image forming process.

As for a developer used in the developing step, a two-component developer containing a toner and a carrier, or a one-component developer containing only a magnetic or non-magnetic toner is used.

Along with developments of technologies of electrophotography, there is a need of a toner having excellent low temperature fixing ability and heat resistant storage stability.

Moreover, a flow improving agent is added to the toner to enhance flowability of the toner.

Japanese Patent Application Laid-Open (JP-A) No. 2011-2557 discloses a toner production method, which contains melting and kneading at least a binder resin, a colorant, and a releasing agent, cooling, and then pulverizing the kneaded product, and classifying to obtain base particles, followed by mixing at least one additive to the base particles to thereby obtain a toner. In this method, the mixing of the additive contains two stages of the mixing step, in which the base particles after the classification and part of the additive are mixed in the first stage of the mixing step, and the rest of the additive is added and mixed with the resulting base particles in the second stage of the mixing step. Moreover, the liberation ratio of the additive to the base particles as measured by an ultrasonic vibration method is 1% to 7%.

However, there are needs for a toner, which can present filming of silica, and can improve transfer stability.

SUMMARY OF THE INVENTION

To solve the aforementioned problems in the art, one embodiment of the present invention aims to provide a toner, which has excellent low temperature fixing ability, heat resistant storage stability, and transfer stability, and can prevent filming of silica.

The means for solving the aforementioned problems are as follows:

Specifically, one embodiment of the present invention is a toner, which contains:

silica particles containing first silica particles, and second silica particles, wherein the toner is a toner produced by depositing the silica particles on surfaces of base particles, wherein the first silica particles have an average primary particle diameter of 75 nm to 250 nm, wherein the second silica particles have an average primary particle diameter of 10 nm to 50 nm, wherein a mass ratio of the first silica particles to the base particles is 0.010 to 0.040, wherein a mass ratio of the second silica particles to the base particles is 0.005 to 0.030, wherein a liberation ratio of the silica particles from the toner by a ultrasonic vibration method is 5% by mass to 20% by mass, and wherein an amount of particles having primary particle diameters of 30 nm or smaller in the silica particles librated from the toner by the ultrasonic vibration method is 20% by number or less.

One embodiment of the present invention can provide a toner, which has excellent low temperature fixing ability, heat resistant storage stability, and transfer stability, and can prevent filming of silica.

DETAILED DESCRIPTION OF THE INVENTION

Figure 1:
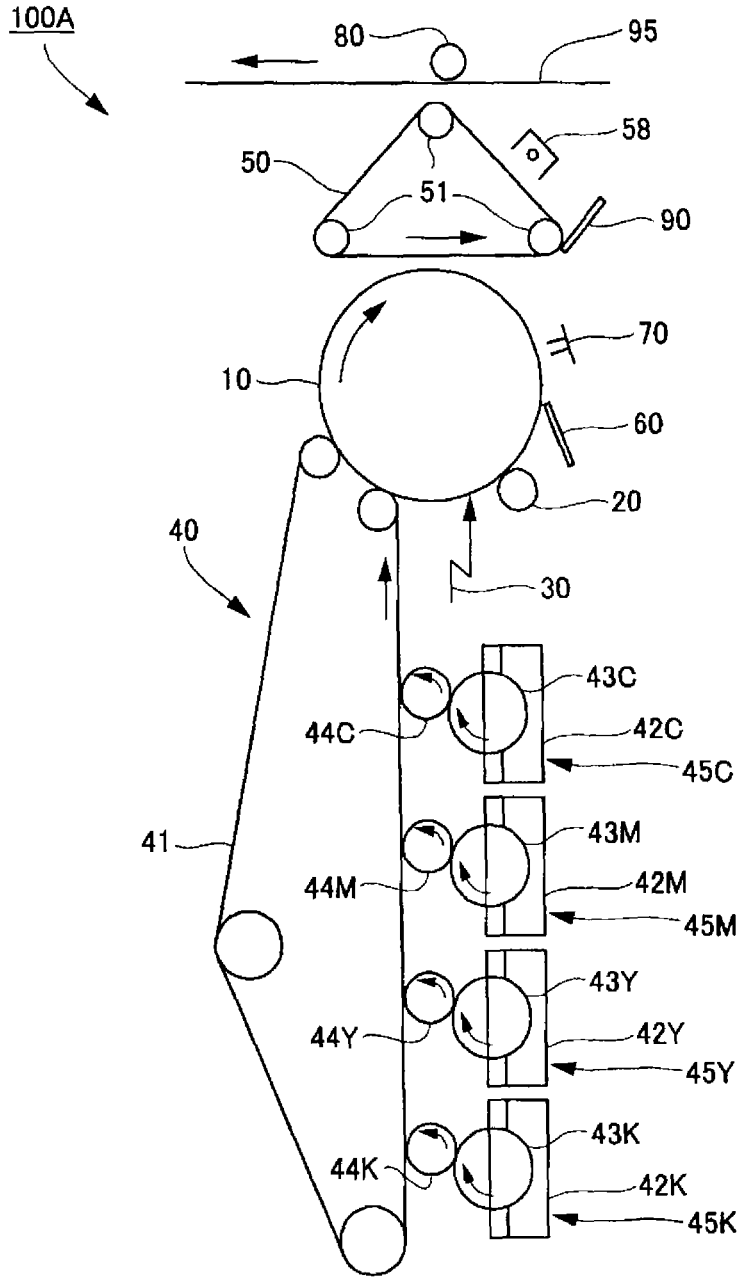
FIG. 1 is a schematic diagram illustrating one example of the image forming apparatus.

One embodiment of the toner of the present invention is explained next.

The toner is produced by depositing silica particles on surfaces of base particles.

The silica particles contains first silica particles and second silica particles, where the first silica particles and the second silica particles have different average primary particle diameters.

Filming of silica is caused with solidified silica particles, which are librated from a toner, particularly silica particles having small particle diameters, on a photoconductor. The silica particles having small particle diameters are librated from the toner, and deposited on the photoconductor, followed by being aggregated to be solidified. On the other hand, silica particles having large diameters are hardly aggregated, and therefore such silica particles are not solidified. The silica particles having large diameter therefore scrape the aggregated and solidified silica particles off from the photoconductor.

In order to prevent filming of silica, it is considered that liberation of the silica particles from the toner is inhibited. In this case, however, heat resistant storage stability of the toner is impaired, as the silica particles are embedded in the base particles.

Therefore, the first silica particles and the second silica particles, which have different average primary particle diameter to each other, are deposited on surfaces of the base particles in a manner that a certain amount of the silica particles are librated. As a result, the silica particles are prevented from being embedded in the base particles, and transfer stability and heat resistant storage stability of a resulting toner are secured. Among the librated silica particles, the silica particles having small diameters are aggregated and solidified on the photoconductor, but the silica particles having large diameters among the librated silica particles are hardly aggregated, and thus not solidified. Therefore, the silica particles having large diameters scrap the aggregated and solidified silica particles off from the photoconductor. As a result, filming of silica can be prevented.

As the silica particles having small diameters are aggregated and solidified on the photoconductor, the silica particles having large diameters are prevented from scraping a surface of the photoconductor.

The average primary particle diameter of the first silica particles is 75 nm to 250 nm, preferably 120 nm to 200 nm. When the average primary particle diameter of the first silica particles is smaller than 75 nm, filming of silica occurs. When the average primary particle diameter thereof is greater than 250 nm, transfer stability of a resulting toner is impaired.

The average primary particle diameter of the second silica particles is 10 nm to 50 nm, preferably 20 nm to 40 nm. When average primary particle diameter of the second silica particles is smaller than 10 nm, filming of silica occurs. When the average primary particle diameter thereof is greater than 50 nm, transfer stability of a resulting toner is impaired.

The average primary particle diameter of the silica particles used in the present invention is measured as specifically described above. A measuring device used is a laser scattering particle size distribution analyzer "LA-920" (manufactured by HORIBA, Ltd.).

Setting of measurement conditions and analysis of measurement data are performed using the special software attached to LA-920 "HORIBA LA-920 for Windows (registered trademark) WET (LA-920) Ver. 2.02". A measurement solvent used is ethanol. The measurement is performed using a flow cell in a circulating system. Measurement conditions are as follows.

Ultrasonic wave: Level 3

Circulation speed: Level 3

Relative refractive index: 1.08

The procedure of the measurement is as follows.

Ethanol is allowed to circulate, and about 1 mg (i.e., an amount in which transmittance is 70% to 95%) of silica powder is gradually added and dispersed therein. In addition, an ultrasonic dispersing treatment is performed for 60 seconds.

Note that, the ultrasonic dispersing treatment is appropriately adjusted so that the temperature of water in a water vessel falls within the range of 10° C. to 40° C.

Thereafter, the particle size distribution is measured.

A mass ratio of the first silica particles to the base particles is 0.010 to 0.040, more preferably 0.020 to 0.030. When the mass ratio of the first silica particles to the base particles is less than 0.010, transfer stability of a resulting toner is impaired. When the mass ratio of the first silica particles to the base particles is greater than 0.040, low temperature fixing ability of a resulting toner is impaired.

A mass ratio of the second silica particles to the base particles is 0.005 to 0.030, preferably 0.010 to 0.020. When the mass ratio of the second silica particles to the base particles is less than 0.005, heat resistant storage stability and transfer stability of a resulting toner are impaired. When the mass ratio of the second silica particles to the base particles is greater than 0.030, low temperature fixing ability of a resulting toner is impaired.

A liberation ratio of the silica particles librated from the toner by an ultrasonic vibration method is 5% by mass to 20% by mass, more preferably 10% by mass to 15% by mass. When the liberation ratio of the silica particles librated from the toner by a ultrasonic vibration method is less than 5% by mass, heat resistant storage stability of a resulting toner is impaired, as well as causing filming of silica. When the liberation ratio thereof is greater 20% by mass, filming of silica occurs.

An amount of particles having particle diameters or 30 nm or smaller in the silica particles librated from the toner by the ultrasonic vibration method is 20% by number or less, preferably 15% by number or less. When the mount of particles having particle diameters or 30 nm or smaller in the silica particles librated from the toner by the ultrasonic vibration method is greater than 20% by number, filming of silica occurs.

A toner, which has excellent low temperature fixing ability, heat resistant storage stability, and transfer stability, and can prevent filming of silica, can be provided by appropriately adjusting conditions or order of depositing the first silica particles and the second silica particles, which have different average primary particle diameters to each other, depending on a type or hardness of the base particles.

A production method of the base particles is appropriately selected depending on the intended purpose without any limitation, and examples thereof include a pulverization method, an emulsion polymerization aggregation method, and a dissolution suspension method. Use of a dissolution suspension method is preferable in order to obtain base particles having small particle diameter, and a narrow particle size distribution.

The production method of the base particles using the pulverization method preferably contains: melt-kneading a toner composition including a binder resin; pulverizing the melt-kneaded toner composition; and classifying the pulverized toner composition.

Note that, the production method of the base particles using the pulverization method may further contain applying mechanical impact to control shapes of the base particles, for the purpose of controlling the average circularity of the toner to 0.97 or greater. In this case, the mechanical impact can be applied, for example, by means of a device, such as a hybridizer, and a mechanofusion.

The production method of the base particles using the emulsion polymerization aggregation method preferably contains: subjecting a monomer serving as a precursor of a binder resin to emulsion polymerization in an aqueous medium to prepare a dispersion liquid of the binder resin; mixing the dispersion liquid of the binder resin with a dispersion liquid, in which a toner composition exclusive of the binder resin is dispersed in an aqueous medium, to cause aggregation; and heating and fusing the aggregated particles.

Specific examples of the aqueous medium include water (e.g., distilled water, and ion-exchanged water), and alcohol. These may be used in combination.

The aqueous medium preferably contains a surfactant.

Examples of the surfactant include: an anionic surfactant, such as a sulfuric acid ester salt-based surfactant, a sulfonic acid salt-based surfactant, a phosphoric acid ester-based surfactant, and a soap-based surfactant; a cationic surfactant, such as an amine salt-based surfactant, and a quaternary ammonium salt-based surfactant; and a nonionic surfactant, such as a polyethylene glycol-based surfactant, an alkylphenol ethylene oxide adduct-based surfactant, and a polyhydric alcohol-based surfactant. These may be used in combination. Among them, an ionic surfactant is preferable, and the anionic surfactant and the cationic surfactant are more preferable.

Specific examples of the anionic surfactant include: fatty acid soap, such as potassium laurate, sodium oleate, and caster oil sodium salt; sulfuric acid ester, such as octyl sulfate, lauryl sulfate, lauryl ether sulfate, nonyl phenyl ether sulfate; sulfonic acid salt, such as lauryl sulfonate, dodecyl benzene sulfonate, sodium alkylnaphthalene sulfonate (e.g., triisopropyl naphthalene sulfonate, and dibutyl naphthalene sulfonate), a naphthalene sulfonate-formalin condensate, monooctyl sulfosuccinate, dioctyl sulfosuccinate, lauric acid amide sulfonate, and oleic acid amide sulfonate; phosphoric acid ester, such as lauryl phosphate, isopropyl phosphate, and nonyl phenyl ether phosphate; dialkylsulfosuccinic acid salt, such as sodium dioctylsulfosuccinate; and sulfosuccinic acid salt, such as 2-sodium lauryl sulfosuccinate.

Specific examples of the cationic surfactant include: amine salt, such as lauryl amine hydrochloride, stearyl amine hydrochloride, oleyl amine acetate, stearyl amine acetate, and stearylaminopropyl amine acetate; and quaternary ammonium salt, such as lauryl trimethyl ammonium chloride, dilauryl dimethyl ammonium chloride, distearyl ammonium chloride, distearyldimethyl ammonium chloride, lauryl dihydroxyethylmethyl ammonium chloride, oleyl bispolyoxyethylene methyl ammonium chloride, lauroyl aminopropyl dimethyl ethyl ammonium ethosulfate, lauroylaminopropyl dimethyl hydroxyethyl ammonium perchlorate, alkyl benzene dimethyl ammonium chloride, and alkyl trimethyl ammonium chloride.

Specific example of the nonionic surfactant include: alkyl ether, such as polyoxyethylene octyl ether, polyoxyethylene lauryl ether, polyoxyethylene stearyl ether, and polyoxyethylene oleyl ether; alkylphenyl ether, such as polyoxyethylene octylphenyl ether, and polyoxyethylene nonylphenyl ether; alkyl ester, such as polyoxyethylene laurate, polyoxyethylene stearate, and polyoxyethylene oleate; alkyl amine, such as polyoxyethylene laurylamino ether, polyoxyethylene stearylamino ether, polyoxyethylene oleylamino ether, polyoxyethylene soyamino ether, polyoxyethylene beef tallow-amino ether; alkyl amide, such as polyoxyethylene lauric acid amide, polyoxyethylene stearic acid amide, and polyoxyethylene oleic acid amide; vegetable oil ether, such as polyoxyethylene caster oil ether, and polyoxyethylene rapeseed oil ether; alkanol amide, such as lauric diethanolamide, stearic diethanolamide, and oleic diethanolamide; and sorbitan ester ether, such as polyoxyethylene sorbitan monolaurate, polyoxyethylene sorbitan monopalmitate, polyoxyethylene sorbitan monostearate, and polyoxyethylene sorbitan monooleate.

An amount of the surfactant in the dispersion liquid of the binder resin is typically 0.01% by mass to 1% by mass, preferably 0.02% by mass to 0.5% by mass, and more preferably 0.1% by mass to 0.2% by mass. When the amount of the surfactant in the dispersion liquid of the binder resin is less than 0.01% by mass, aggregation may be cause especially in a state where pH of the dispersion liquid of the binder resin is not sufficiently basic. When the amount thereof is greater than 1% by mass, low temperature fixing ability of a resulting toner may be impaired.

Amount of the surfactant in the dispersion liquid, in which the toner composition excluding the binder resin is dispersed in the aqueous medium, is typically 0.01% by mass to 10% by mass, preferably 0.1% by mass to 5% by mass, and more preferably 0.5% by mass to 0.2% by mass. When the amount of the surfactant in the dispersion liquid, in which the toner composition excluding the binder resin is dispersed in the aqueous medium, is less than 0.01% by mass, certain particles may be librated, as stability between particles is different during aggregation. When the amount thereof is greater than 10% by mass, a particle size distribution of the particles may be wide, or it may be difficult to control particle diameters.

At the time of the aggregation, pH can be controlled. Also, an aggregating agent may be added in order to perform aggregation of particles stably and speedy, as well as obtaining base particles having a narrow particle size distribution.

The aggregating agent is preferably a compound having monovalent or higher electric charge.

Specific examples of the aggregating agent include: an ionic surfactant having a different polarity to that of particles to be aggregated; acid, such as hydrochloric acid, sulfuric acid, nitric acid, acetic acid, and oxalic acid; a metal salt of inorganic acid, such as magnesium chloride, sodium chloride, aluminum sulfate, calcium sulfate, ammonium sulfate, aluminum nitrate, silver nitrate, copper sulfate, and sodium carbonate; a metal salt of aliphatic acid, such as sodium acetate, potassium formate, sodium oxalate, sodium phthalate, and potassium salicylate; a metal salt of aromatic acid; a metal salt of phenol, such as sodium phenolate; a metal salt of amino acid; and inorganic acid salt of aliphatic or aromatic amine, such as triethanolamine hydrochloride, and aniline hydrochloride. Among them, a metal salt of inorganic acid is preferable in view of stability of the aggregated particles, stability of the aggregating agent with heat or age, and easiness of washing.

An amount of the aggregating agent for use varies depending on a valence of electric charge. In case of monovalency, the amount thereof is typically 3% by mass or less relative to the aqueous medium. In case of divalency, the amount thereof is typically 1% by mass or less relative to the aqueous medium. In case of trivalency, the amount thereof is typically 0.5% by mass or less relative to the aqueous medium.

At the time when the aggregated particles are heated and fused, the aggregated particles are preferably heated to temperature equal to or higher than glass transition temperature of the binder resin to fuse the particles.

The production method of the base particles using the emulsion polymerization aggregation method preferably further contains: washing the heated and fused particles; and drying the washed particles.

At the time when the heated and fused particles are washed, washing is typically performed by adding an acidic or basic aqueous solution to the heated and fused particles in an amount that is a few times the amount of the particles, and the mixture is stirred, followed by subjected to filtration. Next, pure water is added to the filtered product in an amount that is a few times the amount of the filtered product, and the mixture is stirred, followed by subjected to filtration. The aforementioned series of operations is repeated until pH of a resulting filtrate becomes about 7.

At the time when the washed particles are dried, it is preferred that the particles be dried at temperature lower than the glass transition temperature of the binder resin. In this case, the heating is performed, optionally by circulating dry air, or under vacuum conditions.

The production method of the base particles using the dissolution suspension method preferably contains: dissolving or dispersing, in an organic solvent, a toner composition containing the binder resin, or a prepolymer serving as one component of a precursor of the binder resin, to prepare a first liquid; emulsifying or dispersing the first liquid in an aqueous medium to prepare a second liquid; and removing the organic solvent from the second liquid.

The organic solvent is appropriately selected depending on the intended purpose without any limitation, provided that it can dissolve or disperse the toner composition. Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used in combination. Among them, an ester-based solvent is preferable, and ethyl acetate is particularly preferable.

The organic solvent preferably has a boiling point of 150° C. or lower in view of easiness of removal thereof.

A mass ratio of the organic solvent to the toner composition is typically 0.4 to 3, preferably 0.6 to 1.4, and more preferably 0.8 to 1.2.

Note that, components of the toner composition, other than the binder resin or the prepolymer may be added into the aqueous medium, or may be added to the aqueous medium, when the first liquid is added to the aqueous medium.

The aqueous medium is appropriately selected from those known in the art without any limitation. For example, water, or a solvent miscible with water can be used as the aqueous medium. These may be used in combination. Among them, water is preferable.

The solvent miscible with water is not particularly limited as long as it is miscible with water. Examples thereof include alcohol, dimethyl formamide, tetrahydrofuran, cellosolve, and lower ketone.

Examples of the alcohol include methanol, isopropanol, and ethylene glycol.

Examples of the lower ketone include acetone, and methyl ethyl ketone.

The aqueous medium preferably contains a dispersant according to the necessity, in order to stabilize oil droplets, and sharpen a particle size distribution with maintaining desired particle shapes.

The dispersant is appropriately selected depending on the intended purpose without any limitation, and examples thereof include a surfactant, a water-insoluble inorganic compound dispersant, and polymeric protective colloid. These may be used in combination. Among them, a surfactant is preferable.

Examples of an anionic surfactant as the surfactant include an alkyl benzene sulfonic acid salt, α-olefin sulfonic acid salt, and phosphoric acid ester. Among them, an anionic surfactant having a fluoroalkyl group is preferable.

Examples of the anionic surfactant having a fluoroalkyl group include C2-C10 fluoroalkyl carboxylic acid or a metal salt thereof, disodium perfluorooctane sulfonyl glutamate, sodium 3-[ω-fluoroalkyl(C6-C11)oxy)-1-alkyl(C3-C4) sulfonate, sodium 3-[ω-fluoroalkanoyl(C6-C8)-N-ethylamino]-1-propanesulfonate, fluoroalkyl(C11-C20) carboxylic acid or a metal salt thereof, perfluoroalkylcarboxylic acid (C7-C13) or a metal salt thereof, perfluoroalkyl(C4-C12)sulfonate or a metal salt thereof, perfluorooctanesulfonic acid diethanol amide, N-propyl-N-(2-hydroxyethyl)perfluorooctanesulfone amide, perfluoroalkyl(C6-C10) sulfoneamidepropyltrimethylammonium salt, a salt of perfluoroalkyl(C6-C10)-N-ethylsulfonylglycin and monoperfluoroalkyl(C6-C16) ethylphosphate.

Examples of a commercial product of the anionic surfactant having a fluoroalkyl group include: SURFLON S-111, S-112, S-113 (all manufactured by Asahi Glass Co., Ltd.); FLUORAD FC-93, FC-95, FC-98, FC-129 (all manufactured by Sumitomo 3M Limited); UNIDYNE DS-101, DS-102 (all manufactured by DAIKIN INDUSTRIES, LTD.); MEGAFAC F-110, F-120, F-113, F-191, F-812, F-833 (all manufactured by DIC Corporation); EFTOP EF-102, 103, 104, 105, 112, 123A, 123B, 306A, 501, 201, 204 (all manufactured by Mitsubishi Materials Electronic Chemicals Co., Ltd.); and FUTARGENT F-100, F-150 (all manufactured by NEOS COMPANY LIMITED).

Examples of the water-insoluble inorganic compound dispersant include calcium phosphate.

In the case where the dispersant, which can be dissolved with acid (e.g., calcium phosphate) and alkali, is used, the dispersant can be removed by a method where the particles are washed with water after the dispersant is dissolved with acid, such as hydrochloric acid, or a method where the dispersant is decomposed by enzyme.

Examples of the polymeric protective colloid include acid, a (meth)acryl-based monomer containing a hydroxyl group, ether with vinyl alcohol, an ester of vinyl alcohol and a compound containing a carboxyl group, an amide compound or a methylol compound thereof, chloride, a homopolymer or copolymer of a monomer having a nitrogen atom or heterocyclic ring thereof, polyoxyethylene, and cellulose.

Examples of the acid include acrylic acid, methacrylic acid, α-cyanoacrylic acid, α-cyanomethacrylic acid, itaconic acid, crotonic acid, fumaric acid, maleic acid and maleic anhydride.

Examples of the (meth)acrylic monomer having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloroaniline-2-hydroxypropyl acrylate, 3-chloroaniline-2-hydroxypropyl methacrylate, diethylene glycol monoacrylate, diethylene glycol monomethacrylate, glycerin monoacrylate, glycerin monomethacrylate, N-methylol acryl amide, and N-methylol methacryl amide.

Examples of the ether with vinyl alcohol include vinyl methyl ether, vinyl ethyl ether, and vinyl propyl ether.

Examples of the ester of vinyl alcohol and a compound having a carboxyl group include vinyl acetate, vinyl propionate, and vinyl butyrate.

Examples of the amide compound or methylol compound thereof include acryl amide, methacryl amide, diacetone acryl amide, and methylol compounds thereof.

Examples of the chloride include acrylic acid chloride, and methacrylic acid chloride.

Examples of the monomer having a nitrogen atom or heterocyclic ring thereof include vinyl pyridine, vinyl pyrrolidone, vinyl imidazole, and ethylene imine.

Examples of the polyoxyethylene include polyoxy ethylene, polyoxypropylene, polyoxy ethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester.

Examples of the cellulose include methyl cellulose, hydroxyethyl cellulose, and hydroxypropyl cellulose.

A mass ratio of the aqueous medium to the toner composition is typically 0.5 to 20, preferably 1 to 10. When the mass ratio of the aqueous medium to the toner composition is less than 0.50, a dispersion state of the toner composition becomes poor, and therefore base particles of desired particle diameters may not be obtained. When the mass ratio thereof is greater than 20, a production cost may increase.

Examples of a disperser used for the emulsification or dispersion of the first liquid in the aqueous medium include a low speed shearing disperser, and a high speed shearing disperser.

Examples of a method for removing the organic solvent from the second liquid include: a method where the entire reaction system is gradually heated to completely evaporate and remove the organic solvent in oil droplets; and a method where an emulsified dispersion liquid is sprayed in a dry atmosphere to completely remove a water-insoluble organic solvent in oil droplets, as well as evaporating and removing an aqueous dispersant.

The production method of the base particles using the dissolution suspension method preferably further contains: removing the organic solvent from the second liquid to wash formed particles; and drying the washed particles.

The washed particles may be classified.

When the washed particles are classified, a fine particle component is preferably removed, for example by a cyclone, a decanter, or centrifugal separation.

Note that, classification may be performed on the dried particles.

The binder resin contained in the base particles is not particularly limited, and examples thereof include crystalline polyester, non-crystalline polyester, urea-modified polyester, urethane-modified polyester, a polymer of styrene or substitution thereof (e.g., polystyrene, poly(p-chlorostyrene), and polyvinyl toluene), a styrene-based copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer), polymethyl methacrylate, polybutyl methacrylate, polyvinyl chloride, polyvinyl acetate, polyethylene, polypropylene, an epoxy resin, an epoxy polyol resin, polyurethane, polyamide, polyvinyl butyral, polyacrylic acid, rosin, modified rosin, a terpene resin, an aliphatic or alicyclic hydrocarbon resin, and an aromatic petroleum resin. These may be used in combination. Among them, polyester is preferable, and crystalline polyester and/or non-crystalline polyester is more preferable, as a resulting toner can achieve sharp melt during fixing to level a surface of an image, and the toner attains sufficient plasticity even with a low molecular weight.

A weight average molecular weight of the binder resin is typically 3,000 or greater, preferably 5,000 to 1,000,000, and more preferably 7,000 to 500,000. When the weight average molecular weight of the binder resin is smaller than 3,000, hot offset resistance of a resulting toner may be poor.

The glass transition temperature of the binder resin is typically 30° C. to 70° C., preferably 40° C. to 65° C. When the glass transition temperature of the binder resin is lower than 30° C., heat resistant storage stability of a resulting toner may be impaired. When the glass transition temperature thereof is higher than 70° C., low temperature fixing ability of a resulting toner may be impaired.

An amount of polyester in the binder resin is appropriately selected depending on the intended purpose without any limitation, and the amount thereof is, for example, 50% by mass or greater. When the amount of the polyester in the binder resin is less than 50% by mass, low temperature fixing ability of a resulting toner may be impaired.

The non-crystalline polyester preferably contain a constitutional unit originated from polyol, which is represented by the general formula (1), and a constitutional unit originated from polycarboxylic acid, which is represented by the general formula (2):

$$A\text{-}(OH)m \qquad \text{General Formula (1)}$$

In the formula above, A is a C1-C20 alkyl group, C1-C20 alkylene group, an aromatic group that may have a substituent, or a heterocyclic aromatic group, and m is an integer of 2 to 4.

$$B\text{—}(COOH)n \qquad \text{General Formula (2)}$$

In the formula above, B is a C1-C20 alkyl group, C1-C20 alkylene group, an aromatic group that may have a substituent, or a heterocyclic aromatic group, and, and n is an integer of 2 to 4.

Examples of the polyol represented by the general formula (1) include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methyl propane triol, 2-methyl-1,2,4-butanetriol, trimethylol ethane, trimethylol propane, 1,3,5-trihydroxy methyl benzene, bisphenol A, bisphenol A ethylene oxide adduct, bisphenol A propylene oxide adduct, hydrogenated bisphenol A, hydrogenated bisphenol A ethylene oxide adduct, and hydrogenated bisphenol A propylene oxide adduct. These may be used in combination.

Examples of the polycarboxylic acid represented by the general formula (2) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-bicarboxyl-2-methyl-2-methylene carboxypropane, 1,2,4-cyclohexane tricarboxylic acid, tetra(methylene carboxy) methane, 1,2,7,8-octane tetracarboxylic acid, pyromellitic acid, Empol trimer acid, cyclohexane dicarboxylic acid, cyclohexane dicarboxylic acid, butanetetracarboxylic acid, diphenyl sulfone tetracarboxylic acid, and ethylene glycol bis(trimellitic acid). These may be used in combination.

An acid value of the non-crystalline polyester is typically 1 KOHmg/g to 50 KOHmg/g, preferably 5 KOHmg/g to 30 KOHmg/g. When the acid value of the non-crystalline polyester is 1 KOHmg/g or greater, a resulting toner tends to be negatively charged, and therefore the toner has excellent affinity to paper during fixing to the paper, to thereby improve low temperature fixing ability of the toner. When the acid value of the non-crystalline polyester is greater than 50 KOHmg/g, however, charge stability of a toner with respect to fluctuation of the environment may be impaired.

A hydroxyl value of the non-crystalline polyester is typically 5 KOHmg/g or greater.

The crystalline polyester has such thermofusion characteristics that a viscosity thereof dramatically drops at temperature around melt inset temperature. Therefore, a toner containing the crystalline polyester has excellent heat resistant storage stability up to the melt inset temperature, and the toner also has excellent heat resistant storage stability and low temperature fixing ability, as the viscosity thereof dramatically reduces at the melt inset temperature and the toner is fixed. Moreover, the toner containing the crystalline polyester has an excellent result in a releasing width, i.e. a difference between the minimum fixing temperature and hot offset onset temperature.

The crystalline polyester preferably contains a structure represented by the general formula (A):

$$—OCO—(CR_1{=}CR_2)_m—COO—(CH_2)_n— \quad \text{General Formula (A)}$$

In the formula above, n is a number of repeating units, m is an integer of 1 to 3, and $R_1$ and $R_2$ are each independently a hydrogen atom or a hydrocarbon group.

Examples of an alcohol component for use in synthesis of the crystalline polyester include a C2-C6 diol compound. Among them, preferred are 1,4-butanediol, 1,6-hexanediol, and derivatives thereof.

An amount of the C2-C6 diol compound in the alcohol component is typically 80 mol % or greater, preferably 85 mol % or greater.

Examples of an acid component for use in synthesis of the crystalline polyester include fumaric acid, carboxylic acid containing a C=C double bond, and derivatives thereof.

As for a method for controlling crystallinity and softening point of the crystalline polyester, there is a method where polycondensation reaction is performed by adding trihydric or higher polyhydric alcohol, such as glycerin, as the alcohol component, or adding trivalent or higher polyvalent carboxylic acid, such as trimellitic acid, as the acid component, to thereby synthesize a non-linear polyester.

A molecular structure of the crystalline polyester can be confirmed by solution or solid NMR spectroscopy, X-ray diffraction spectroscopy, GC/MS, LC/MS, or IR spectroscopy. As for a simple method thereof, the molecular structure thereof can be confirmed with absorption based on δCH (out plane bending) of olefin at 965±10 $cm^{-1}$ and 990±10 $cm^{-1}$ in the infrared absorption spectrum.

In view of low temperature fixing ability, the crystalline polyester preferably has a peak position of 3.5 to 4.0 and a peak half width of 1.5 or less in a molecular weight (M) of an o-dichlorobenzene soluble component thereof where a horizontal axis represents log (M), a longitudinal axis represents % by mass, and has the weight average molecular weight (Mw) of 1,000 to 30,000, the number average molecular weight (Mn) of 500 to 6,000, and Mw/Mn of 2 to 10.

The endothermic peak temperature of the crystalline polyester as measured by DSC is preferably 50° C. to 130° C. When the endothermic peak temperature as measured by DSC is lower than 50° C., heat resistant storage stability of a resulting toner is impaired, and therefore blocking of the toner may be easily caused at internal temperature of a developing apparatus. When the endothermic peak temperature thereof is higher than 130° C., low temperature fixing ability of a resulting toner may be impaired.

In view of low temperature fixing ability, an acid value of the crystalline polyester is typically 5 mgKOH/g or greater, preferably 10 mgKOH/g or greater. In view of hot offset resistance, the acid value of the crystalline polyester is typically 45 mgKOH/g or less.

In view of low temperature fixing ability and charging properties, a hydroxyl value of the crystalline polyester is typically 0 mgKOH/g to 50 mgKOH/g, preferably 5 mgKOH/g to 50 mgKOH/g.

The precursor of the binder resin is preferably a prepolymer having a group reactable with an active hydrogen group and a compound having an active hydrogen group.

The first liquid, in which the toner composition containing the prepolymer having a group reactable with an active hydrogen group is dissolved or dispersed in the organic solvent, may be emulsified or dispersed in the aqueous medium, together with the compound having an active hydrogen group. Alternatively, the first liquid, in which the toner composition containing the prepolymer having a group reactable with an active hydrogen group is dissolved or dispersed in the organic solvent, may be emulsified or dispersed in the aqueous medium, to which the compound having an active hydrogen group is added in advance. Further, the first liquid, in which the toner composition containing the prepolymer having a group reactable with an active hydrogen group is dissolved or dispersed in the organic solvent, may be dissolved r dispersed in the aqueous medium, followed by adding the compound having an active hydrogen thereto. In this case, the binder resin is generated preferentially on a surface of each base particle and thus it is possible to form a concentration gradient of the binder resin.

Note that, conditions of a reaction between the prepolymer having a group reactable with an active hydrogen group and the compound having an active hydrogen group may be appropriately selected depending on a combination of the prepolymer having a group reactable with an active hydrogen group and the compound having an active hydrogen group for use.

The duration of the reaction between the prepolymer having a group reactable with an active hydrogen group, and the compound having the active hydrogen group is typically 10 minutes to 40 hours, preferably 2 hours to 24 hours.

The prepolymer having a group reactable with an active hydrogen group is not particularly limited, as long as it has a group reactable with an active hydrogen group. Examples thereof include a polyol resin, an acryl resin, polyester, an epoxy resin, and derivatives thereof. These may be used in combination. Among them, polyester is preferable in view of high fluidity during melted, and transparency thereof.

The group reactable with an active hydrogen group is not particularly limited, and examples thereof include an isocyanate group, an epoxy group, a carboxyl group, and an acid chloride group. These may be used in combination. Among them, an isocyanate group is preferable.

The base particles preferably contain urea-modified polyester (RMPE) as a binder resin derived from a prepolymer, as a molecular weight of a high molecular component can be easily controlled, and excellent mold-releasing property and fixing ability can be secured even when a resulting toner is used in oil-less low temperature fixing, especially in an apparatus that does not contain a releasing oil coating system for a heating member for fixing.

The urea-modified polyester (RMPE) can be synthesized by reacting polyester prepolymer (A) having an isocyanate group with amine (B).

The urea-modified polyester (RMPE) may have a urethane bond.

In this case, a molar ratio (urea bond/urethane bond) of the urea bonds to the urethane bonds in the urea-modified polyester (RMPE) is typically 100/0 to 10/90, preferably 80/20 to 20/80, and more preferably 60/40 to 30/70. When the molar ratio (urea bond/urethane bond) of the urea bonds to the urethane bonds in the urea-modified polyester (RMPE) is less than 10/1, hot offset resistance of a resulting toner may be impaired.

The polyester prepolymer (A) having an isocyanate group can be synthesized by allowing polyol (PO) and polycarboxylic acid (PC) to react through polycondensation to synthesize polyester having a hydroxyl group, followed by allowing the polyester having a hydroxyl group and polyisocyanate (PIC) to react.

The polyol (PO) is appropriately selected depending on the intended purpose without any limitation, and examples thereof include diol (DIO), trihydric or higher polyol (TO), and a mixture containing diol (DIO) and trihydric or higher polyol (TO). These may be used in combination. Among them, the diol (DIO) alone, and a mixture containing the diol (DIO) and a small amount of the trihydric or higher polyol (TO) are preferable.

Examples of the diol (DIO) include alkylene glycol, alkylene ether glycol, alicyclic diol, an alkylene oxide adduct of alicyclic diol, bisphenol, and an alkylene oxide adduct of bisphenol. Among them, preferred are C2-C12 alkylene glycol, and an alkylene oxide adduct of bisphenol, and more preferred are an alkylene oxide adduct of bisphenol, and a mixture of an alkylene oxide adduct of bisphenol and C2-C12 alkylene glycol.

Examples of the alkylene glycol include ethylene glycol, 1,2-propylene glycol, 1,3-propylene glycol, 1,4-butanediol, and 1,6-hexanediol.

Examples of the alkylene ether glycol include diethylene glycol, triethylene glycol, dipropylene glycol, polyethylene glycol, polypropylene glycol, and polytetramethylene ether glycol.

Examples of the alicyclic diol include 1,4-cyclohexane dimethanol, and hydrogenated bisphenol A.

Examples of the alicyclic diol alkylene oxide adduct include an adduct obtained by adding alkylene oxide (e.g., ethylene oxide, propylene oxide, and butylene oxide) to alicyclic diol.

Examples of the bisphenol include bisphenol A, bisphenol F, and bisphenol S.

Examples of the bisphenol alkylene oxide adduct include an adduct obtained by adding alkylene oxide (e.g., ethylene oxide, propylene oxide, butylene oxide) to bisphenol.

Examples of trihydric or higher polyol (TO) include trihydric or higher polyhydric aliphatic alcohol, trihydric or higher polyphenol, and an alkylene oxide adduct of trihydric or higher polyphenol.

Examples of the trihydric or higher polyhydric aliphatic alcohol include glycerin, trimethylol ethane, trimethylol propane, pentaerythritol, and sorbitol.

Examples of the trihydric or higher polyphenol include trisphenol (e.g., trisphenol PA, manufactured by HONSHU CHEMICAL INDUSTRY CO., LTD.), phenol novolak, and cresol novolak.

Examples of the alkylene oxide adduct of trihydric or higher polyphenol include compounds obtained by adding an alkylene oxide (e.g., ethylene oxide, propylene oxide, and butylene oxide) to trihydric or higher polyphenol.

A blending mass ratio (DIO/TO) of the diol (DIO) to the trihydric or higher polyol (TO) in the mixture of the diol (DIO) and the trihydric or higher polyol (TO) is preferably 100/0.01 to 10/1, more preferably 100/0.01 to 1/1.

The polycarboxylic acid (PC) is appropriately selected depending on the intended purpose without any limitation, and examples thereof include dicarboxylic acid (DIC), trivalent or higher polycarboxylic acid (TC), and a mixture containing dicarboxylic acid (DIC) and trivalent or higher polycarboxylic acid (TC). These may be used in combination. Among them, dicarboxylic acid (DIC) alone, and a mixture containing DIC and a small amount of trivalent or higher polycarboxylic acid (TC) are preferable. Particularly, preferred are C4-C20 alkenylene dicarboxylic acid, and C8-C20 aromatic dicarboxylic acid.

Examples of the dicarboxylic acid (DIC) include alkylene dicarboxylic acid, alkenylene dicarboxylic acid, and aromatic dicarboxylic acid.

Examples of the alkylene dicarboxylic acid include succinic acid, adipic acid, and sebacic acid.

Examples of the alkenylene dicarboxylic acid include maleic acid, and fumaric acid.

Examples of the aromatic dicarboxylic acid include phthalic acid, isophthalic acid, terephthalic acid, and naphthalene dicarboxylic acid.

Examples of the trivalent or higher polycarboxylic acid (TC) include aromatic polycarboxylic acid.

The aromatic polycarboxylic acid preferably is preferably C9-C20 aromatic polycarboxylic acid.

Examples of the aromatic polycarboxylic acid include trimellitic acid, and pyromellitic acid.

Instead of the polycarboxylic acid (PC), acid anhydride or lower alkyl ester of at least one selected from the group consisting of the dicarboxylic acid (DIC), the trivalent or higher polycarboxylic acid (TC), and a mixture of the dicarboxylic acid (DIC) and the trivalent or higher polycarboxylic acid may be used.

Examples of the lower alkyl ester include methyl ester, ethyl ester, and isopropyl ester.

A blending mass ratio (DIC/TC) of the dicarboxylic acid (DIC) to the trivalent or higher polycarboxylic acid (TC) in the mixture of the dicarboxylic acid (DIC) and the trivalent or higher polycarboxylic acid (TC) is preferably 100/0.01 to 10/1, more preferably 100/0.01 to 1/1.

An equivalent ratio ([OH]/[COOH]) of hydroxyl groups [OH] in the polyol (PO) to carboxyl groups [COOH] in the polycarboxylic acid (PC) when the polyol (PO) and the polycarboxylic acid (PC) is allowed to react through a polycondensation reaction is typically 2/1 to 1/1, preferably 1.5/1 to 1/1, and more preferably 1.3/1 to 1.02/1.

An amount of the constitutional unit derived from the polyol (PO) in the polyester prepolymer (A) having an isocyanate group is typically 0.5% by mass to 40% by mass, preferably 1% by mass to 30% by mass, and more preferably 2% by mass to 20% by mass. When the amount of the constitutional unit derived from the polyol (PO) in the polyester prepolymer (A) having an isocyanate group is less than 0.5% by mass, hot offset resistance of a resulting toner is impaired, and therefore it may be difficult to attain both heat resistant storage stability and low temperature fixing ability of the toner. When the amount thereof is greater than 40% by mass, low temperature fixing ability of a resulting toner may be impaired.

The polyisocyanate (PIC) is appropriately selected depending on the intended purpose without any limitation, and examples thereof include aliphatic polyisocyanate, alicyclic polyisocyanate, aromatic diisocyanate, aromatic aliphatic diisocyanate, and isocyanurate. These may be used in combination.

Examples of the aliphatic polyisocyanate include tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexanediisocyanate, and tetramethylhexanediisocyanate.

Examples of the alicyclic polyisocyanate include isophorone diisocyanate, and cyclohexylmethane diisocyanate.

Examples of the aromatic diisocyanate include tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate.

Examples of the aromatic aliphatic diisocyanate include α,α,α',α'-tetramethylxylene diisocyanate.

Examples of the isocyanurate include tris(isocyanatoalkyl)isocyanurate, and tri(isocyanatocycloalkyl)isocyanurate.

Instead of the polyisocyanate (PIC), a phenol derivative of the polyisocyanate (PIC), or the polyisocyanate (PIC) blocked with oxime or caprolactam may be used.

An equivalent ratio ([NCO]/[OH]) of isocyanate groups [NCO] in the polyisocyanate (PIC) to hydroxyl groups [OH] in the polyester having a hydroxyl group when the polyisocyanate (PIC) and the polyester having a hydroxyl group are allowed to react is typically 5/1 to 1/1, preferably 4/1 to 1.2/1, and more preferably 3/1 to 1.5/1. When the equivalent ratio [NCO]/[OH] is greater than 5/1, low temperature fixing ability of a resulting toner may be impaired. When the equivalent ratio [NCO]/[OH] is less than 1/1, offset resistance of a resulting toner may be impaired.

An amount of the constitutional unit derived from the polyisocyanate (PIC) in the polyester prepolymer (A) having an isocyanate group is typically 0.5% by mass to 40% by mass, preferably 1% by mass to 30% by mass, and more preferably 2% by mass to 20% by mass. When the amount of the constitutional unit derived from the polyisocyanate (PIC) in the polyester prepolymer (A) having an isocyanate group is less than 0.5% by mass, hot offset resistance of a resulting toner is impaired, and therefore it may be difficult to attain both heat resistant storage stability and low temperature fixing ability of the toner. When the amount thereof is greater than 40% by mass, low temperature fixing ability of a resulting toner may be impaired.

A number of isocyanate groups per molecule of the polyester prepolymer (A) having an isocyanate group is typically 1 or more, preferably 1.2 to 5, and more preferably 1.5 to 4. When the number of isocyanate groups per molecule of the polyester prepolymer (A) having an isocyanate group is less than 1, a molecular weight of a resulting urea-modified polyester (RMPE) becomes small, and therefore hot offset resistance of a resulting toner may be impaired.

The weight average molecular weight of a tetrahydrofuran-soluble component of the prepolymer having a group reactable with an active hydrogen group is typically 3,000 to 40,000, preferably 4,000 to 30,000. When the weight average molecular weight of a tetrahydrofuran-soluble component of the prepolymer having a group reactable with an active hydrogen group is smaller than 3,000, heat resistant storage stability of a resulting toner may be impaired. When weight average molecular weight thereof is greater than 40,000, low temperature fixing ability of a resulting toner may be impaired.

Note that, the weight average molecular weight of a tetrahydrofuran-soluble component of the prepolymer having a group reactable with an active hydrogen group can be measured by gel permeation chromatography (GPC).

The amine (B) is not particularly limited, and examples thereof include diamine, trivalent or higher polyamine, amino alcohol, amino mercaptan, and amino acid. These may be used in combination.

Examples of the diamine compound include: aromatic diamine (e.g., phenylene diamine, diethyltoluene diamine, and 4,4'-diaminodiphenyl methane), alicyclic diamine (4,4'-diamino-3,3'-dimethyldicyclohexyl methane, diamine cyclohexane, and isophorone diamine), and aliphatic diamine (e.g., ethylene diamine, tetramethylene diamine, and hexamethylene diamine).

Examples of the trivalent or higher polyamine include diethylene triamine, and triethylene tetramine.

Examples of the amino alcohol include ethanol amine, and hydroxyethyl aniline.

Examples of the amino mercaptan include aminoethylmercaptan, and aminopropylmercaptan.

Examples of amino acid compound include amino propionic acid, and amino caproic acid. Examples of the compound whose amino group is blocked include a ketimine compound obtained from the amine and ketone (e.g., acetone, methyl ethyl ketone, and methyl isobutyl ketone), and an oxazoline compound. Among these amines, preferred are the diamine compound, and a mixture of the diamine compound and a small amount of the polyamine compound.

Note that, a compound, in which an amino group of the amine (B) is blocked, may be used instead of the amine (B).

In the case where the urea-modified polyester (RMPE) and the non-crystalline polyester are used in combination as the binder resin, the urea-modified polyester (RMPE) and the non-crystalline polyester are preferably compatible to each other at least part thereof. The compatibility between these resins can improve low temperature fixing ability and hot offset resistance of a resulting toner. To this end, polyol and polycarboxylic acid used for synthesizing the urea-modified polyester (RMPE), and those used for synthesizing the non-crystalline polyester are preferably similar compositions, respectively.

Specific examples of a combination of the urea-modified polyester (RMPE) and the non-crystalline polyester include the following (1) to (10);

(1) a mixture containing: a compound obtained through ureation of polyester prepolymer with isophorone diamine, where the polyester prepolymer is obtained through a reaction of a polycondensation product between a bisphenol A ethylene oxide (2 mol) adduct and isophthalic acid with isophorone diisocyanate; and a polycondensation product between a bisphenol A ethylene oxide (2 mol) adduct and isophthalic acid;

(2) a mixture containing a compound obtained through ureation of a polyester prepolymer with isophorone diamine, where the polyester prepolymer is obtained through a reaction of a polycondensation product between a bisphenol A ethylene oxide (2 mol) adduct and isophthalic acid with isophorone diisocyanate; and a polycondensation product between a bisphenol A ethylene oxide (2 mol) adduct and terephthalic acid;

(3) a mixture containing: a compound obtained through ureation of a polyester prepolymer with isophorone diamine, where the polyester prepolymer is obtained through a reaction of a polycondensation product between a bisphenol A ethylene oxide (2 mol) adduct/bisphenol A propylene oxide (2 mol) adduct and terephthalic acid with isophorone diisocyanate; and a polycondensate between bisphenol A ethylene oxide (2 mol) adduct/bisphenol A propylene oxide (2 mol) adduct and terephthalic acid;

(4) a mixture containing a compound obtained through ureation of a polyester prepolymer with isophorone diamine where the polyester prepolymer is obtained through a reaction of a polycondensation product between a bisphenol A ethylene oxide (2 mol) adduct/bisphenol A propylene oxide (2 mol) adduct and terephthalic acid with isophorone diisocyanate; and a polycondensation product between a bisphenol A propylene oxide (2 mol) adduct and terephthalic;

(5) a mixture containing: a compound obtained through ureation of a polyester prepolymer with hexamethylene diamine, where the polyester prepolymer is obtained through a reaction of a polycondensation product between a bisphenol A ethylene oxide (2 mol) adduct and terephthalic acid with isophorone diisocyanate; and a polycondensation product between a bisphenol A ethylene oxide (2 mol) adduct and terephthalic acid;

(6) a mixture containing: a compound obtained through ureation of a polyester prepolymer with hexamethylene diamine, where the polyester prepolymer is obtained through a reaction of a polycondensation product between a bisphenol A ethylene oxide (2 mol) adduct and terephthalic acid with isophorone diisocyanate; and a polycondensation product between a bisphenol A ethylene oxide (2 mol) adduct/bisphenol A propylene oxide (2 mol) adduct and terephthalic acid;

(7) a mixture containing: a compound obtained through ureation of a polyester prepolymer with ethylene diamine, where the polyester prepolymer is obtained through a reaction of a polycondensation product between a bisphenol A ethylene oxide (2 mol) adduct and terephthalic acid with isophorone diisocyanate; and a polycondensation product between a bisphenol A ethylene oxide (2 mol) adduct and terephthalic acid;

(8) a mixture containing: a compound obtained through ureation of a polyester prepolymer with hexamethylene diamine, where the polyester prepolymer is obtained through a reaction of a polycondensation product between a bisphenol A ethylene oxide (2 mol) adduct and isophthalic acid with diphenyl methane diisocyanate; and a polycondensation product between a bisphenol A ethylene oxide (2 mol) adduct and isophthalic acid;

(9) a mixture containing: a compound obtained through ureation of a polyester prepolymer with hexamethylene diamine, where the polyester prepolymer is obtained through a reaction of a polycondensation product between bisphenol A ethylene oxide (2 mol) adduct/bisphenol A propylene oxide (2 mol) adduct and terephthalic acid/dodecenyl succinic acid anhydride with diphenylmethane diisocyanate; and a polycondensation product between a bisphenol A ethylene oxide (2 mol) adduct/bisphenol A propylene oxide (2 mol) adduct and terephthalic acid; and

(10) a mixture containing a compound obtained through ureation of a polyester prepolymer with hexamethylene diamine, where the polyester prepolymer is obtained through a reaction of a polycondensation product between a bisphenol A ethylene oxide (2 mol) adduct and isophthalic acid with toluene diisocyanate; and a polycondensation product between a bisphenol A ethylene oxide (2 mol) adduct and isophthalic acid.

The toner may further contain a colorant, a releasing agent, a charge controlling agent, a flow improving agent other than silica particles, a cleaning improving agent, and a magnetic material.

The colorant is appropriately selected from dyes and pigments known in the art depending on the intended purpose without any limitation. Examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture thereof. These may be used in combination.

An amount of the colorant in the toner is typically 1% by mass to 15% by mass, preferably 3% by mass to 10% by mass. When the amount of the colorant in the toner is less than 1% by mass, tinting strength of a resulting toner may be low. When the amount thereof is greater than 15% by mass, a dispersion failure of the colorant is caused in a resulting toner, which may reduce tinting strength of the toner, or impair electric properties of the toner.

The colorant may be used as a master batch, in which the colorant forms a composite with a resin.

The resin is appropriately selected from those known in the art depending on the intended purpose without any limitation, and examples thereof include polyester, a polymer of styrene or a derivative thereof, a styrene-based copolymer, polymethyl methacrylate, polybutyl methacrylate, polyvinyl chloride, polyvinyl acetate, polyethylene, polypropylene, an epoxy resin, epoxy polyol resin, polyurethane, polyamide, polyvinyl butyral, polyacrylic acid, rosin, modified rosin, a terpene resin, an aliphatic hydrocarbon resin, an alicyclic hydrocarbon resin, and aromatic petroleum resin. These may be used in combination.

Examples of the polymer of styrene or a derivative thereof include polystyrene, poly(p-chlorostyrene), and polyvinyl toluene.

Examples of the styrene-based copolymer include styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer.

The master batch can be produced by mixing or kneading the resin and the colorant together through application of high shearing force. Preferably, an organic solvent may be used for improving the interactions between the colorant and the resin. Moreover, a so-called flashing method is preferably used, since a wet cake of the colorant can be directly used without being dried. The flashing method is a method in which an aqueous paste containing a colorant is mixed or kneaded with a resin and an organic solvent, and then the colorant is transferred to the resin to remove the moisture and the organic solvent.

In the mixing or kneading, for example, a high-shearing disperser (e.g., a three-roll mill) can be used.

The releasing agent is appropriately selected depending on the intended purpose without any limitation, but it is preferably a releasing agent having a low melting point, whose melting point is in the range of 50° C. to 120° C. The releasing agent having a low melting temperature effectively acts as a releasing agent an interface between a fixing roller and the toner, as it is dispersed in the binder resin. As a result, excellent hot offset resistance can be attained in oilless fixing (no releasing agent, such as oil, is applied onto a fixing roller).

Examples of the releasing agent include natural wax. These may be used in combination.

Examples of the natural wax include vegetable wax (e.g. carnauba wax, cotton wax, Japan wax, and rice wax), animal wax (e.g., bees wax and lanolin), mineral wax (e.g., ozokelite and ceresin), and petroleum wax (e.g., paraffin wax, microcrystalline wax and petrolatum).

Examples of the wax other than the natural wax listed above include: synthetic hydrocarbon wax (e.g., Fischer-Tropsch wax, polyethylene wax and polypropylene wax); synthetic wax (e.g., ester wax, ketone wax and ether wax); fatty acid amide (12-hydroxystearic acid amide, stearic amide, and phthalic anhydride imide); and low-molecular-weight crystalline polymer resin such as acrylic homopolymer (e.g., poly-n-stearyl methacrylate and poly-n-lauryl methacrylate) and acrylic copolymer (e.g., n-stearyl acrylate-ethyl methacrylate copolymer); and crystalline polymer having a long alkyl group as a side chain.

A melting point of the releasing agent is typically 50° C. to 120° C., preferably 60° C. to 90° C. When the melting point of the releasing agent is lower than 50° C., heat resistant storage stability of the toner may be impaired. When the melting point thereof is higher than 120° C., the low temperature fixing ability of the toner may be impaired.

A melt viscosity of the releasing agent at temperature higher than the melting point of the releasing agent by 20° C. is typically 5 cps to 1,000 cps, preferably 10 cps to 100 cps. When the melt viscosity of the releasing agent at temperature higher than the melting point of the releasing agent by 20° C. is less than 5 cps, a releasing ability of the toner may be impaired. When the melt viscosity thereof is greater than 1,000 cps, hot offset resistance and low temperature fixing ability of the toner may be impaired.

An amount of the releasing agent in the toner is typically 0% by mass to 40% by mass, preferably 3% by mass to 30% by mass. When the amount of the releasing agent in the toner is greater than 40% by mass, a flow ability of the toner may be impaired.

The charge controlling agent is appropriately selected from those known in the art depending on the intended purpose without any limitation, and examples thereof include a nigrosine dye, a triphenylmethane dye, a chrome-containing metal complex dye, a molybdic acid chelate pigment, a rhodamine dye, alkoxy amine, a quaternary ammonium salt (including fluorine-modified quaternary ammonium salt), alkylamide, phosphorus or a compound thereof, tungsten or a compound thereof, a fluorosurfactant, a metal salt of salicylic acid, and a metal salt of a salicylic acid derivative. These may be used in combination.

Examples of a commercial product of the charge controlling agent include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by Hoechst AG); LRA-901, and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, and quaternary ammonium salt.

A mass ratio of the charge controlling agent to the binder resin is typically 0.1% by mass to 10% by mass, preferably 0.2% by mass to 5% by mass. When the mass ratio of the charge controlling agent to the binder resin is less than 0.1% by mass, a charge control ability of the toner may be reduced. When the mass ratio thereof is greater than 10% by mass, charging ability of the toner becomes excessively large, and therefore electrostatic force with the developing roller increases to reduce flowability of the developer, or reduce image density.

The flow improving agent other than the aforementioned silica particles is appropriately selected from those known in the art depending on the intended purpose without any limitation, and examples thereof include alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. These may be used in combination.

The flow improving agent is preferably hydrophobic treated with, for example, a silane coupling agent, a sililation agent, a silane-coupling agent containing a fluoroalkyl group, an organic titanate-based coupling agent, an aluminum-based coupling agent, silicone oil, or modified-silicone oil.

The cleaning improving agent is added to a toner in order to remove any residual toner on a photoconductor, or a primary transfer member, and examples thereof include fatty acid metal salt (e.g., zinc stearate, and calcium stearate), and polymer particles produced by soap-free emulsification polymerization, such as polymethyl methacrylate particles, and polystyrene particles.

The polymer particles preferably have a relatively narrow particle size distribution, and the volume average particle diameter thereof is preferably 0.01 μm to 1 μm.

The magnetic material is appropriately selected from those known in the art depending on the intended purpose, and examples thereof include a metal (e.g., ferrite, magnetite, reduced iron, cobalt, manganese, and nickel), an alloy, and a compound containing any of the aforementioned metals. These may be used in combination.

One embodiment of the developer of the present invention is explained next.

The developer contains the aforementioned toner, and may further contain a carrier.

The carrier typically contains core particles each having magnetism, and a protective layer containing a resin, which is formed on surfaces of the core particles.

The weight average particle diameter of the carrier is typically 20 μm to 45 μm. When the weight average particle diameter of the carrier is smaller than 20 μm, carrier depositions tend to be caused. When the weight average particle diameter thereof is greater than 45 μm, variations in diameters of printed dots tent to be large, which may impair granulation (roughness).

Note that, the weight average particle diameter of the carrier can be measured by means of a micro track particle size analyzer, model HRA9320-X100 (manufactured by Honeywell).

A mass magnetic susceptibility of the carrier as a magnetic field of 1,000 oersteds (Oe) is applied is typically 40 emu/g to 100 emu/g, preferably 50 emu/g to 90 emu/g. When the mass magnetic susceptibility of the carrier as a magnetic field of 1,000 oersteds is applied is less than 40 emu/g, carrier deposition may occur. When the mass magnetic susceptibility of the carrier as a magnetic field of 1,000 oersteds is applied is greater than 100 emu/g, trace of the magnetic brush may be left strongly.

Note that, the mass magnetic susceptibility of the carrier as a magnetic field of 1,000 oersteds is applied can be measured in the following manner. As a measuring device, a B-H tracer (BHU-60, manufactured by Riken Denshi Co., Ltd.) is used. A cylindrical cell is filled with 1 g of the carrier, and set in the device. The magnetic field is gradually increased up to 3,000 oersteds, followed by gradually decreased to 0. Thereafter, the magnetic field of the opposite direction is gradually increased to 3,000 oersteds, followed by gradually decreased to 0. Thereafter, the magnetic field of the same direction to that of the initial magnetic field is applied. In this manner, a B-H curve is drawn, and a mass magnetic susceptibility of the carrier as the magnetic field of 1,000 oersteds is applied is calculated from the B-H curve.

A material constituting the core particle is not particularly limited, and examples thereof include a ferromagnetic material (e.g., iron, and cobalt), magnetite, hematite, Li-based ferrite, MnZn-based ferrite, CuZn-based ferrite, NiZn-based ferrite, Ba-based ferrite, and Mn-based ferrite.

A common logarithm of electrical resistivity of the carrier is typically 11 [log(Ω·cm)] to 17 [log(Ω·cm)], preferably 11.5 [log(Ω·cm)] to 16.5 [log(Ω·cm)]. When the common logarithm of the electrical resistivity of the carrier is less than 11 [log(Ω·cm)], in the case that a developing gap is narrow, carrier deposition tends to occur as charge is lead to the carrier. When the common logarithm of the electrical resistivity of the carrier is greater than 17 [log(Ω·cm)], on the other hand, the edge effect is enhanced to reduce the image density in a solid image area, and charge having an opposite polarity to that of the toner tends to accumulated to charge the carrier, so that the carrier deposition tends to occur.

The resin contained in the protective layer is not particularly limited, and examples thereof include a styrene-based resin, such as polystyrene, chloropolystyrene, poly-α-methyl styrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylic acid ester copolymer (e.g., a styrene-methyl acrylate copolymer, a styrene-ethyl acrylate copolymer, a styrene-butyl acrylate copolymer, a styrene-octyl acrylate copolymer, and a styrene-phenyl acrylate copolymer), a styrene-methacrylic ester copolymer (e.g., a styrene-methyl methacrylate copolymer, a styrene-ethyl methacrylate copolymer, a styrene-butyl methacrylate copolymer, and a styrene-phenyl methacrylate copolymer), a styrene-methyl α-chloroacrylate copolymer, and a styrene-acrylonitrile-acrylic acid ester copolymer; an epoxy resin; a polyester resin; a polyethylene resin; a polypropylene resin; an iomer resin; a polyurethane resin; a ketone resin; an ethylene-ethyl acrylate copolymer; a xylene resin; a polyamide resin; a phenol resin; a polycarbonate resin; a melamine resin; a fluororesin; and a silicone resin. These may be used in combination. Among them, a silicone resin is preferable.

As for the silicone resin, a straight silicone resin can be used.

Examples of a commercial product of the straight silicone resin include: KR271, KR272, KR282, KR252, KR255, and KR152 (all manufactured by Shin-Etsu Chemical Co., Ltd.); and SR2400, and SR2406 (both manufactured by Dow Corning Toray Co., Ltd.).

As for the silicone resin, a modified silicone resin can be used.

Examples of the modified silicone resin include an epoxy-modified silicone resin, an acryl-modified silicone resin, a phenol-modified silicone resin, a urethane-modified silicone resin, a polyester-modified silicone resin, and an alkyd-modified silicone resin.

Examples of a commercial product of the modified silicone resin include: an epoxy-modified silicone resin ES-1001N, an acryl-modified silicone resin KR-5208, a polyester-modified silicone resin KR-5203, an alkyd-modified silicone resin KR-206, and a urethane-modified silicone resin KR-305 (all manufactured by Shin-Etsu Chemical Co., Ltd.); and an epoxy-modified silicone resin SR2115, and an alkyd-modified silicone resin SR2110 ((both manufactured by Dow Corning Toray Co., Ltd.).

The protective layer may further contain an amino silane coupling agent. Use of the amino silane coupling agent in the protective layer can improve durability of a resulting carrier.

An amount of the amino silane coupling agent in the protective layer is typically 0.001% by mass to 30% by mass.

A method for forming a protective layer onto each of the core particles is not particularly limited, and examples thereof include spray dry, dip coating, and powder coating. Among them, a method using a fluid bed coating device is preferable as it is effective in formation of a uniform coating layer.

The protective layer may further contain an electroconductive powder.

The electroconductive powder is not particularly limited, and examples thereof include ZnO powder, Al powder, selenium oxide powder, alumina powder, $SiO_2$ powder subjected to a hydrophobic surface treatment, $TiO_2$ powder, $SnO_2$ powder doped with various elements, $TiB_2$ powder, $ZnB_2$ powder, $MoB_2$ powder, silicon carbide powder, polyacetylene powder, polyparaphenylene powder, poly(p-phenylene sulfide) powder, polypyrrol powder, polyethylene powder, furnace black, acetylene black, and channel black.

The protective layer can be formed in the following manner. After adding the electroconductive powder to a solvent or a resin solution, homogeneously dispersing the resulting mixture or solution by means of a disperser using media, such as a ball mill, or a bead mill, or a stirrer equipped with a wing that rotates at high speed, to thereby prepare a coating liquid. The coating liquid is then applied onto surfaces of the core particles, to thereby form a protective layer on each core particle.

A thickness of the protective layer is typically 0.02 μm to 1 μm, preferably 0.03 μm to 0.8 μm.

A bulk density of the carrier is typically 2.15 g/cm$^3$ to 2.70 g/cm$^3$, preferably 2.25 g/cm$^3$ to 2.60 g/cm$^3$. When the bulk density of the carrier is less than 2.15 g/cm$^3$, the bulk susceptibility of the carrier becomes small, and therefore carrier deposition tends to occur. The carrier having the bulk density of greater than 2.70 g/cm$^3$ can be produced by elevating firing temperature. In this case, however, core particles tend to be fused to each other, which may be difficult to be cracked.

Note that, the bulk density of the carrier can be measured in the following manner in accordance with a metal powder-apparent density testing method (JIS-Z-2504). The carrier is naturally flown out from an orifice having a diameter of 2.5 mm to a cylindrical stainless steel container having the volume of 25 cm$^3$, which is placed directly under the orifice until the container is overflowed with the carrier. The carrier at the top of the container is scraped out in once procedure with a non-magnetic horizontal spatula by moving the spatula along the top edge of the container. A mass of the carrier flown into the container is divided with the volume of the container to determine a bulk density of the carrier. In the case where the carrier is difficult to flow out from the orifice having a diameter of 2.5 mm, an orifice having a diameter of 5 mm is used to naturally flow the carrier therefrom.

One embodiment of the image forming apparatus of the present invention is explained next.

The image forming apparatus contains a photoconductor, an electrostatic latent image forming unit, a developing unit, a transferring unit, and a fixing unit, and may further contain a cleaning unit, a diselectrification unit, a recycling unit, and a controlling unit according to the necessity.

A material, shape, structure, and size of the photoconductor are appropriately selected from those known in the art.

Examples of the photoconductor include: an inorganic material, such as amorphous silicon, and selenium; and an organic material, such as polysilane, and phtharopolymethine. Among them, amorphous silicon is preferable because of its long service life.

The shape of the photoconductor is preferably a drum-shape.

The electrostatic latent image forming unit preferably contains a charging device configured to uniformly charge a surface of the photoconductor, and an exposure device configured to expose the surface of the photoconductor to light.

The charging device is configured to apply voltage to a surface of the photoconductor.

The charging device is appropriately selected depending on the intended purpose, and examples thereof include a conventional contact charging device equipped with an electroconductive or semiconductive roller, brush, film, or rubber blade, and a non-contact charging device utilizing corona discharge, such as corotron, and scorotron.

The exposure device is configured to expose a surface of the photoconductor to light.

The exposure device is appropriately selected depending on the intended purpose, and examples thereof include various exposure devices, such as a reproduction optical exposing device, a rod-lens array exposing device, a laser optical exposure device, and a liquid crystal shutter optical device.

Note that, an exposure device of a back light system, where exposure is performed from a back side of the photoconductor, may be used.

The developing unit is configured to develop the electrostatic latent image with the aforementioned toner, to thereby form a toner image.

The developing unit is appropriately selected from those known in the art, but the developing unit preferably contains a developing device, which houses the aforementioned toner therein, and can apply the toner to the electrostatic latent image in a contact or non-contact manner.

The developing device may be a developing device for a single color, or a developing device for multiple colors. Specific examples of the developing device include a developing device equipped with a stirrer configured to stir the developer to cause frictions to thereby charge the developer, and a rotatable magnet roller. The developer housed in the developing device is the aforementioned developer, but the developer may be a one-component developer or two-component developer.

In the developing device housing therein the two-component developer, the toner and a carrier are mixed and stirred, and the toner is charged with the friction caused by the mixing and stirring. The charged toner is held on a surface of a rotating magnetic roller in a form of a brush, to thereby form a magnetic brush. The magnet roller is provided adjacent to the photoconductor, and therefore part of the toner constituting the magnetic brush on the surface of the magnetic roller is moved to the surface of the photoconductor by electric suction force. As a result, the electrostatic latent image is developer with the toner to thereby form the toner image on the surface of the photoconductor.

The transferring unit is configured to transfer the toner image onto a recording medium. The transferring unit is preferably configured to primary transfer the toner image onto an intermediate transfer member, followed by secondary transferring the toner image onto a recording medium. The toner use for this may be a monocolor toner, a full-color toner, or a transparent toner.

The transferring unit preferably contains a primary transferring unit configured to transfer toner images of a plurality of colors onto the intermediate transfer member to thereby form a composite toner image, and a secondary transferring unit configured to transfer the composite toner image onto the recording medium.

The intermediate transfer member is appropriately selected from conventional transfer members depending on the intended purpose. As for the intermediate transfer member, a transfer belt can be used.

The transferring unit preferably contains a transferring device configured to charge the toner image formed on the photoconductor to separate the toner image from the photoconductor to the side of the recording medium.

A number of the transferring unit to be mounted may be one, or two or more.

Specific examples of the transferring device include a corona transferring device using corona discharge, a transfer belt, a transfer roller, a pressure transfer roller, and an adhesion transfer device.

The recording medium is appropriately selected from conventional recording media. As for the recording medium, recording paper can be used.

The fixing unit is configured to fix the toner image, which was been transferred onto the recording medium. The fixing unit may fix the toner image of each color every time each toner image is transferred onto the recording medium, or fix the toner images in the state where the toner images of all colors are superimposed.

The fixing unit is appropriately selected depending on the intended purpose. As for the fixing unit, a conventional heating and pressing unit can be used.

Examples of the heating and pressing unit include a combination of a heating roller and a press roller, and a combination of a heating roller, a press roller, and an endless belt.

The heating by the heating and pressing unit is typically performed at 80° C. to 200° C.

Note that, in combination with or instead of the fixing unit, a conventional light fixing device may be used.

The diselectrification unit is configured to apply diselectrification bias to the photoconductor to perform diselectrification.

The diselectrification unit is appropriately selected from conventional diselectrification device. As for the diselectrification unit, a diselectrification lamp can be used.

The cleaning unit is configured to remove the toner remained on the photoconductor.

The cleaning unit is appropriately selected from conventional cleaners. As for the cleaning unit, a magnetic brush cleaner, an electrostatic brush cleaner, a magnetic roller cleaner, a blade cleaner, a brush cleaner, or a web cleaner can be used. Among them, a blade cleaner is preferable.

The recycling unit is configured to recycle the toner, which has been removed by the cleaning unit, into the developing unit.

The recycling unit is appropriately selected depending on the intended purpose. As for the recycling unit, a conventional transporting unit can be used.

The controlling unit is configured to control each unit.

The controlling unit is appropriately selected depending on the intended purpose. As for the controlling unit, a device, such as a sequencer, and a computer can be used.

The image forming apparatus may contain a process cartridge, which can be detachably mounted in a main body of the image forming apparatus. The process cartridge contains a photoconductor and a developing unit, which are integrated to each other, or may further contain a charging unit, and a cleaning unit, which are further integrated to the aforementioned units.

One example of the image forming apparatus is illustrated in FIG. 1.

The image forming apparatus 100A contains a drum-shaped photoconductor 10, a charging roller 20 as the charging unit, an exposure apparatus 30 as the exposing unit, a developing apparatus 40 as the developing unit, an intermediate transfer member 50, a cleaning apparatus 60 as the cleaning unit, and a diselectrification lamp 70 as the diselectrification unit.

The intermediate transfer member 50 is an endless belt, and is designed to rotate in the direction indicated with an arrow by three rollers 51 disposed inside the intermediate transfer member 50 to support the intermediate transfer member 50. Part of the three rollers 51 also functions as a transfer bias roller capable of applying a predetermined transfer bias (primary transfer bias) to the intermediate transfer member 50. In the surrounding area of the intermediate transfer member 50, the cleaning apparatus 90 having a cleaning blade is provided. Moreover, the transfer roller 80 serving as the transferring unit capable of applying a transfer bias for transferring (secondary transferring) the toner image to the recording paper 95 serving as the recording medium is provided to face the intermediate transfer member 50. In the surrounding area of the intermediate transfer member 50, the corona charger 58, which is configured to apply a charge to the toner image on the intermediate transfer member 50, is provided in the area situated between the contact area of the photoconductor 10 and the intermediate transfer member 50, and the contact area of the intermediate transfer member 50 and the recording paper 95, in the rotation direction of the intermediate transfer member 50.

The developing apparatus 40 contains a developing belt 41 serving as the developer bearing member, and a black developing device 45K, a yellow developing device 45Y, a magenta developing device 45M, and a cyan developing device 45C, which are provided next to the developing belt 41. Note that, the black developing device 45K is equipped with a developer-retention section 42K, a developer supply roller 43K, and a developing roller 44K, the yellow developing device 45Y is equipped with a developer-retention section 42Y, a developer supply roller 43Y, and a developing roller 44Y, the magenta developing unit 45M is equipped with a developer-retention section 42M, a developer supply roller 43M, and a developing roller 44M, and the cyan developing device 45C is equipped with a developer-retention section 42C, a developer supply roller 43C, and a developing roller 44C. Moreover, the developing belt 41 is an endless belt, which is rotatably supported by a plurality of belt rollers, and part of which is in contact with the photoconductor 10.

In the image forming apparatus 100A, the charging device 20 uniformly charges the photoconductor 10, followed by exposing the photoconductor 10 to light using the exposing apparatus 30, to thereby form an electrostatic latent image. Next, a developer is supplied from the developing apparatus 40 to the electrostatic latent image formed on the photoconductor 10 to develop the electrostatic latent image, to thereby form a toner image. The toner image is then transferred (primary transferred) onto the intermediate transfer member 50 upon application of voltage from the roller 51, followed by being transferred (secondary transferred) onto the recording paper 95. As a result, a transferred image is formed on the recording paper 95. Note that, the toner remained on the photoconductor 10 is removed by the cleaning apparatus 60 having a cleaning blade, and the charge of the photoconductor 10 is removed by the diselectrification lamp 70.

Figure 2:
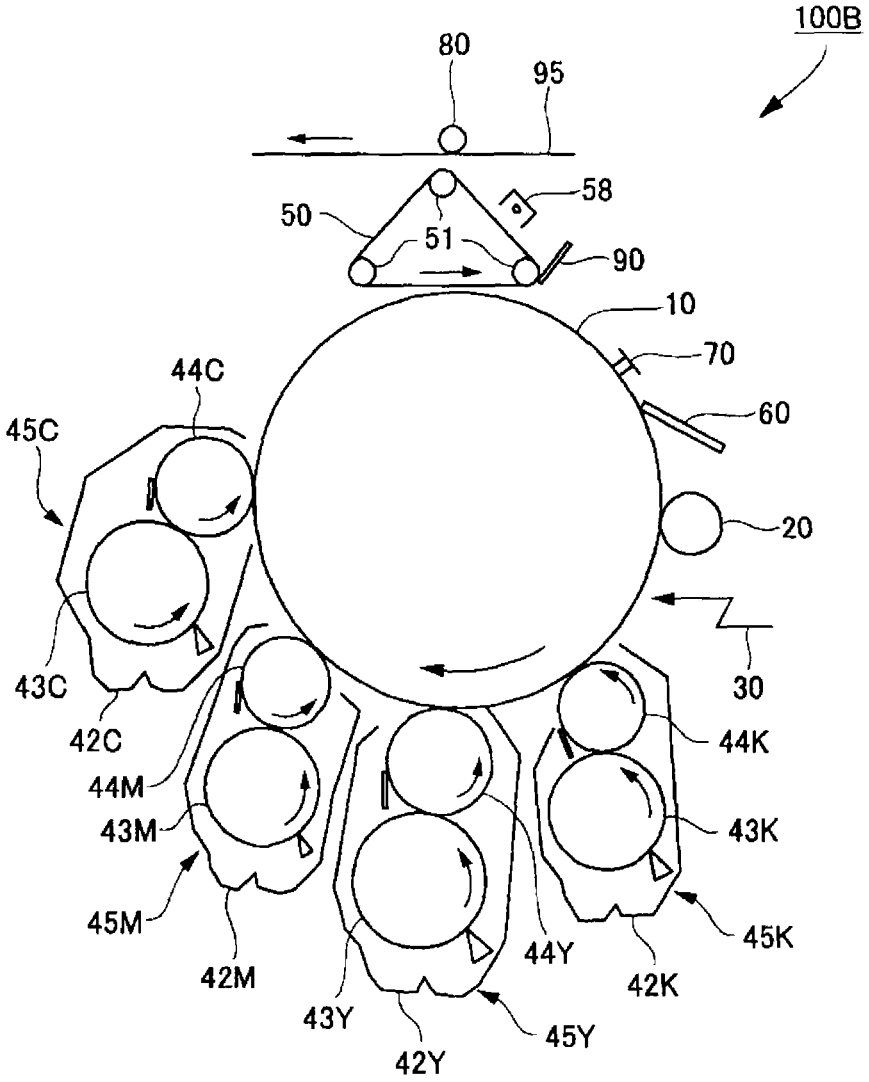
FIG. 2 is a schematic diagram illustrating another example of the image forming apparatus.

Another example of the image forming apparatus is illustrated in FIG. 2.

The image forming apparatus 100B has the same structure and exhibits the same effect to those of the image forming apparatus 100A, provided that the image forming apparatus 100B is not equipped with a developing belt 41, and a black developing unit 45K, a yellow developing unit 45Y, a magenta developing unit 45M, and a cyan developing unit 45C are provided to face the photoconductor 10 in a surrounding area of the photoconductor 10. Note that, the reference numbers of FIG. 2, which are also used in FIG. 1, denote the same to those in FIG. 1.

Figure 3:
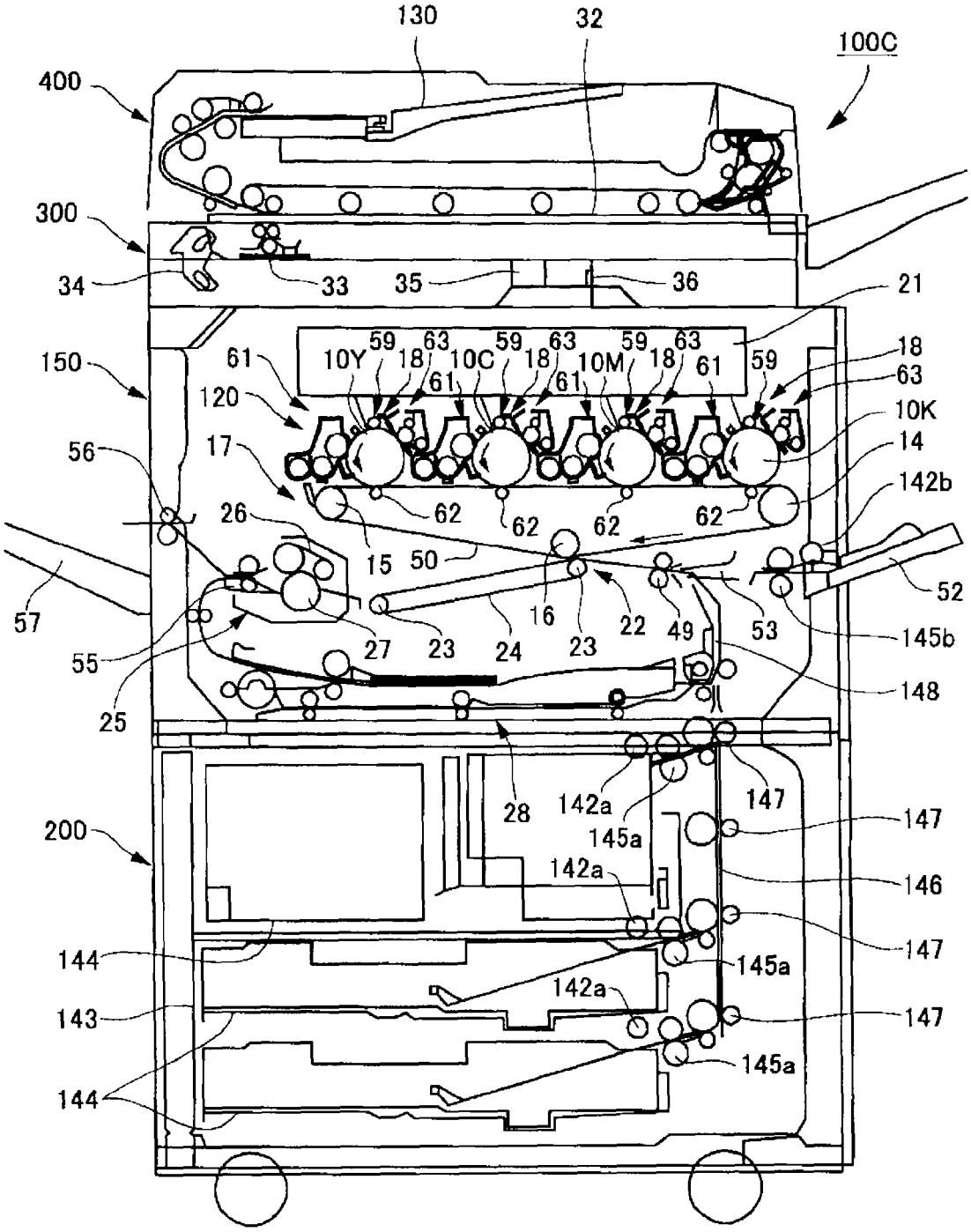
FIG. 3 is a schematic diagram illustrating another example of the image forming apparatus.

Yet another example of the image forming apparatus is illustrated in FIG. 3.

The image forming apparatus 100C is a tandem color image forming apparatus. The image forming apparatus 100C is equipped with an apparatus main body 150, a paper feeding table 200, a scanner 300, and an automatic document feeder (ADF) 400. In the central part of the apparatus main body 150, an intermediate transfer member 50 in the form of an endless belt is provided. The intermediate transfer member 50 is rotatably supported by support rollers 14, 15, and 16 in the clockwise direction in FIG. 3. In the surrounding area of the support roller 15, a cleaning apparatus 17 configured to remove the toner remained on the intermediate transfer member 50 is provided. To the intermediate transfer member 50 supported by the support roller 14 and the support roller 15, a tandem developing device 120, in which four image forming units 18, i.e. yellow, cyan, magenta, and black image forming units, are aligned along the traveling direction of the intermediate transfer member 50, is provided. In the surrounding area of the tandem developing device 120, an exposing apparatus 21 is provided. A secondary transfer apparatus 22 is provided at the opposite side of the intermediate transfer member 50 to the side where the tandem developing device 120 is provided. In the secondary transfer apparatus 22, a secondary transfer belt 24, which is an endless belt, is supported by a pair of rollers 23, and is designed so that recording paper transported on the secondary transfer belt 24 and the intermediate transfer member 50 can be in contact with each other. In the surrounding area of the secondary transfer apparatus 22, a fixing apparatus 25 is provided. The fixing apparatus 25 is equipped with a fixing belt 26, which is an endless belt, and a pressure roller 27 disposed so as to press against the fixing belt 26.

Note that, in the image forming apparatus 100C, a sheet reverser 28, which is configured to reverse the transfer paper to perform image formation on both sides of the transfer paper, is provided in the surrounding area of the secondary transfer apparatus 22 and the fixing apparatus 25.

Next, formation of a full-color image (color copy) using the tandem developing device 120 is explained. First, a document is set on a document table 130 of the automatic document feeder (ADF) 400. Alternatively, the automatic document feeder (ADF) 400 is opened, a document is set on a contact glass 32 of the scanner 300, and then the ADF 400 is closed.

In the case where the document is set on the ADF 400, once a start switch (not illustrated) is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. During this scanning operation, light applied from a light source of the first carriage 33 is reflected on the surface of the document, the reflected light from the document is further reflected by a mirror of the second carriage 34, and passed through an image formation lens 35, which is then received by a read sensor 36. In this manner, the color document (color image) is read, and image information of black, yellow, magenta, and cyan is obtained. The image information of each color, black, yellow, magenta or cyan, is transmitted to respective image forming unit 18 (a black image forming unit, a yellow image forming unit, a magenta image forming unit, and a cyan image forming unit) of the tandem developing device 120, to thereby form a toner image of each color.

A toner image formed on the photoconductor for black 10K, a toner image formed on the photoconductor for yellow 10Y, a toner image formed on the photoconductor for magenta 10M, and a toner image formed on the photoconductor for cyan 10C are sequentially transferred (primary transferred) to the intermediate transfer member 50. On the intermediate transfer member 50, the black toner image, the yellow toner image, the magenta toner image, and the cyan toner image are superimposed to form a composite toner image.

Figure 4:
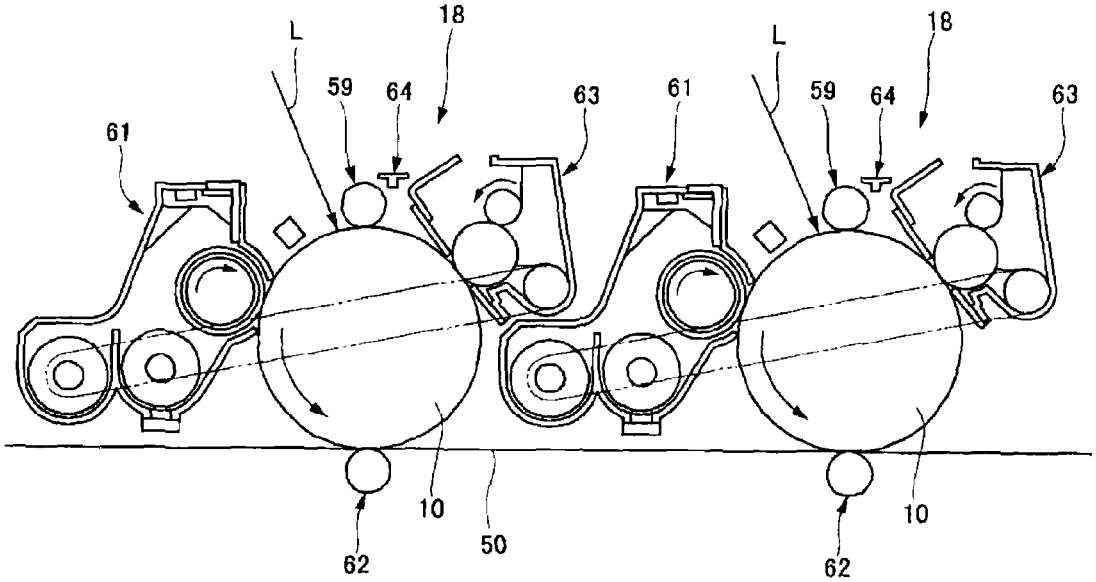
FIG. 4 is a schematic explanatory diagram illustrating part of the image forming apparatus of FIG. 3.

As illustrated in FIG. 4, the image forming unit 18 of each color in the tandem developing device 120 contains the photoconductor 10, the charging device 59 configured to uniformly charge the photoconductor 10, an exposure apparatus configured to apply exposure light L to the photoconductor 10 based on the image formation of each color to form an electrostatic latent image on the photoconductor 10, the developing device 61 configured to develop the electrostatic latent image with the toner of each color to form toner images of all colors on the photoconductor 10, the transfer charging device 62 configured to transfer the toner images of all colors onto the intermediate transfer member 50, the cleaning apparatus 63, and the diselectrification device 64.

In the paper feeding table 200, one of the paper feeding rollers 142*a* is selectively rotated to eject recording paper from one of multiple feeder cassettes 144 of a paper bank 143, the ejected sheets are separated one by one by a separation roller 145 to send to a feeder path 146, and then transported by a transport roller 147 into a feeder path 148 within the apparatus main body 150. The recording paper transported in the feeder path 148 is then bumped against a registration roller 49 to stop. Alternatively, recording paper on a manual-feeding tray 52 are ejected by rotating a feeding roller 142, separated one by one by a separation roller 145 to guide into a manual feeder path 53, and then bumped against the registration roller 49 to stop. Note that, the registration roller 49 is generally earthed at the time of the use, but it may be biased for removing paper dust of the recording paper.

Next, the registration roller 49 is rotated synchronously with the movement of the composite toner image formed on the intermediate transfer member 50, to thereby send the recording paper between the intermediate transfer member 50 and the secondary transfer apparatus 22. As a result, the composite toner image is transferred onto the recording paper. Note that, the toner remained on the intermediate transfer member 50 after the transferring is cleaned by the cleaning apparatus 17.

The recording paper on which the composite toner image has been transferred is transported by a secondary transfer apparatus 22 to send to a fixing apparatus 25. In the fixing apparatus 25, the composite toner image is fixed to the recording paper by heat and pressure. Thereafter, the traveling direction of the recording paper is changed by the switch craw 55 to eject the recording paper by the ejecting roller 56.

The ejected recording paper is stacked on the output tray 57. Alternatively, the traveling direction of the recording paper is changed by the switch craw 55, and the recording paper is reversed by the sheet reverser 28 to send the recording paper again to the transfer position, to thereby record an image on the back side thereof. Then, the recording paper is ejected by the ejecting roller 56, and stacked on the output tray 57.

EXAMPLES

The present invention is more specifically explained through Examples hereinafter. Note that, Examples shall not be construed as to limit the scope of the present invention. In Examples below, "part(s)" denotes "part(s) by mass."

(Measurement of Average Primary Particle Diameter of Silica Particles)

The average primary particle diameter of the silica particles used in the present invention was measured as specifically described above. A measuring device used was a laser scattering particle size distribution analyzer "LA-920" (manufactured by HORIBA, Ltd.).

Setting of measurement conditions and analysis of measurement data were performed using the special software attached to LA-920 "HORIBA LA-920 for Windows (registered trademark) WET (LA-920) Ver. 2.02". A measurement solvent used was ethanol. The measurement was performed using a flow cell in a circulating system. Measurement conditions are as follows.

Ultrasonic wave: Level 3

Circulation speed: Level 3

Relative refractive index: 1.08

The procedure of the measurement is as follows.

Ethanol was allowed to circulate, and about 1 mg (i.e., an amount in which transmittance is 70% to 95%) of silica powder was gradually added and dispersed therein. In addition, an ultrasonic dispersing treatment was performed for 60 seconds.

Note that, the ultrasonic dispersing treatment was appropriately adjusted so that the temperature of water in a water vessel fell within the range of 10° C. to 40° C.

Thereafter, the particle size distribution was measured.

(Production of Base Particles A)

—Synthesis of Crystalline Polyester—

A 5 L four-necked flask equipped with a nitrogen-inlet tube, a condenser, a stirrer, and a thermocouple was charged with 2,300 parts of 1,6-hexanediol, 2,530 parts of fumaric acid, 291 parts of trimellitic anhydride, and 4.9 parts of hydroquinone, and the mixture was allowed to react for 5 hours at 160° C. Next, the resultant was heated to 200° C., and was then allowed to react for 1 hour, followed by further reacting for 1 hour under the reduced pressure of 8.3 kPa, to thereby obtain Crystalline Polyester 1.

—Synthesis of Non-Crystalline Polyester—

A 5 L four-necked flask equipped with a nitrogen-inlet tube, a condenser, a stirrer, and a thermocouple was charged with 229 parts of bisphenol A ethylene oxide (2 mol) adduct, 529 parts of bisphenol A propylene oxide (3 mol) adduct, 208 parts of terephthalic acid, 46 parts of adipic acid, and 2 parts of dibutyl tin oxide. The mixture was then allowed to react for 7 hours at 230° C., followed by further reacting for 4 hours under the reduced pressure of 10 mmHg to 15 mmHg. To the resultant, 44 parts of trimellitic anhydride was added, and the mixture was allowed to react for 2 hours at 180° C., to thereby obtain Non-Crystalline Polyester 1.

—Synthesis of Polyester Prepolymer—

A reaction vessel equipped with a cooling tube, a stirrer, and a nitrogen-inlet tube was charged with 682 parts of bisphenol A ethylene oxide (2 mol) adduct, 81 parts of bisphenol A propylene oxide (2 mol) adduct, 283 parts of terephthalic acid, 22 parts of trimellitic anhydride, and 2 parts of dibutyl tin oxide. The mixture was then allowed to react for 8 hours at 230° C., followed by further reacting for 5 hours under the reduced pressure of 10 mmHg to 15 mmHg, to thereby obtain Polyester 1 having a hydroxyl group. Polyester 1 having a hydroxyl group had the number average molecular weight of 2,100, weight average molecular weight of 9,500, glass transition temperature of 55° C., acid value of 0.5 mgKOH/g, and hydroxyl value of 51 mgKOH/g.

Next, a reaction vessel equipped with a cooling tube, a stirrer, and a nitrogen-inlet tube was charged with 410 parts of Polyester 1 having a hydroxyl group, 89 parts of isophorone diisocyanate, and 500 parts of ethyl acetate, and the resulting mixture was allowed to react for 5 hours at 100° C., to thereby obtain Polyester Prepolymer 1.

—Synthesis of Ketimine—

A reaction vessel equipped with a stirring rod and a thermometer was charged with 170 parts of isophorone diamine, and 75 parts of methyl ethyl ketone, and the resulting mixture was allowed to react for 5 hours at 50° C., to thereby obtain Ketimine 1. Ketimine 1 had the amine value of 418 mgKOH/g.

—Preparation of Master Batch—

After mixing 1,200 parts of water, 540 parts of carbon black Printex 35 (manufactured by Degussa) having DBP oil absorption of 42 mL/100 mg, and pH of 9.5, and 1,200 parts of Non-Crystalline Polyester 1 by means of HENSCHEL MIXER (manufactured by Mitsui Mining Co., Ltd.), the resulting mixture was kneaded for 30 minutes at 150° C. by a two-roll kneader. The resulting kneaded product was then rolled and cooled, followed by pulverized with a pulverizer, to thereby obtain Master Batch 1.

—Preparation of Pigment-Wax Dispersion Liquid—

A vessel equipped with a stirring rod and a thermometer was charged with 378 parts of Non-Crystalline Polyester 1, 110 parts of carnauba wax, 22 parts of a salicylic acid metal complex E-84 (manufactured by Orient Chemical Industries, Ltd.), and 947 parts of ethyl acetate. The resulting mixture was then heated to 80° C., and the temperature was maintained for 5 hours, followed by cooling to 30° C. over 1 hour. To the resultant, 500 parts of Master Batch 1 and 500 parts of ethyl acetate were further added, and the resulting mixture was mixed for 1 hour, to thereby obtain Raw Material Solution 1.

Raw Material Solution 1 (1,324 parts) was transferred to a vessel, and was dispersed by means of a bead mill, ULTRA VISCOMILL, (manufactured by AIMEX CO., Ltd.) under the conditions: a liquid feed rate of 1 kg/hr, disc circumferential velocity of 6 m/s, 0.5 mm-zirconia beads packed to 80% by volume, and 3 passes. To the resultant, 1,042.3 parts of a 65% Non-Crystalline Polyester 1 ethyl acetate solution was added, and the resultant was dispersed by the bead mill once under the aforementioned conditions, to thereby obtain Pigment-Wax Dispersion Liquid 1. Pigment-Wax Dispersion Liquid 1 had the solid content (130° C., 30 min) of 50% by mass.

—Preparation of Crystalline Polyester Dispersion Liquid—

A 2 L metal vessel was charged with 100 g of Crystalline Polyester 1, and 400 g of ethyl acetate. The resultant was then heated to 75° C. to dissolve Crystalline Polyester 1, followed by quenching in an iced-water bath at the rate of 27° C./min. To this, 500 mL of glass beads (diameter: 3 mm) were added, and the resultant was subjected to pulverization for 10 hours by means of a batch-type sand mill (manufactured by Kanpe Hapio Co., Ltd.), to thereby obtain Crystalline Polyester Dispersion Liquid 1.

—Synthesis of Resin Particle Dispersion Liquid—

A reaction vessel equipped with a stirring rod, and a thermometer was charged with 683 parts of water, 11 parts of a sodium salt of sulfuric acid ester of methacrylic acid-ethylene oxide adduct ELEMINOL RS-30 (manufactured by Sanyo Chemical Industries, Ltd.), 138 parts of styrene, 138 parts of methacrylic acid, and 1 part of ammonium persulfate, and the resulting mixture was stirred for 15 minutes at 400 rpm. The resultant was heated to 75° C., and was then allowed to react for 5 hours. To the resultant, 30 parts of a 1% by mass ammonium persulfate aqueous solution was added, and the resulting mixture was aged for 5 hours at 75° C., to thereby obtain Resin Particle Dispersion Liquid 1. Resin Particle Dispersion Liquid 1 had the volume average diameter of 0.14 μm, which was measured by means of a laser diffraction/scattering particle distribution analyzer LA-920 (manufactured by HORIBA, Ltd.).

—Preparation of Aqueous Medium—

Water (990 parts), 83 parts of Resin Particle Dispersion Liquid 1, 37 parts of a 48.5% by mass sodium dodecyldiphenyl ether disulfonate aqueous solution ELEMINOL MON-7 (manufactured by Sanyo Chemical Industries, Ltd.), and 90 parts of ethyl acetate were mixed together and stirred to thereby obtain Aqueous Medium 1.

—Emulsification and Removal of Solvent—

A vessel was charged with 664 parts of Pigment-Wax Dispersion Liquid 1, 109.4 parts of Polyester Prepolymer 1, 120.1 parts of Crystalline Polyester Dispersion Liquid 1, and 4.6 parts of Ketimine 1, and the resulting mixture was mixed for 1 minute at 5,000 rpm by means of a TK homomixer (manufactured by Tokushu Kika Kogyo Co., Ltd.). To the resultant, 1,200 parts of Aqueous Medium 1 was added, followed by mixing the mixture for 60 seconds at 8,000 rpm by means of the TK homomixer, to thereby obtain Emulsified Slurry 1.

A vessel equipped with a stirrer and a thermometer was charged with Emulsified Slurry 1, and the solvent therein was removed at 30° C. for 8 hours. The resultant was then aged for 4 hours at 45° C., to thereby obtain Dispersion Slurry 1.

—Washing and Drying—

Dispersion Slurry 1 (100 parts) was subjected to vacuum filtration. To the filtration cake, 100 parts of ion-exchanged water was added, and the resulting mixture was mixed for 10 minutes at 12,000 rpm by means of the TK homomixer, followed by filtering the mixture. After further adding 100 parts of a 10% by mass sodium hydroxide aqueous solution to the filtration cake, the mixture was mixed for 30 minutes at 12,000 rpm by the TK homomixer, followed by subjecting the mixture to vacuum filtration. Next, to the resulting filtration cake, 100 parts of 10% by mass hydrochloric acid was added, and the mixture was then mixed for 10 minutes at 12,000 rpm by the TK homomixer, followed by filtering the mixture. After adding 100 parts of ion-exchanged water to the filtration cake, the mixture was mixed for 10 minutes at 12,000 rpm by the TK homomixer, followed by filtering the mixture. This series of operation was performed twice.

The resulting filtration cake was dried for 48 hours at 45° C. by means of an air-circulating drier, followed by sieving the resultant with a mesh having an opening size of 75 μm, to thereby obtain Base Particles A.

Example 1

Base Particles A (100 parts), 1.1 parts of first silica particles X-24 (manufactured by Shin-Etsu Chemical Co., Ltd.) having the average primary particle diameter of 120 nm, 0.6 parts of second silica particles H1303VP (manufactured by Clariant Japan K.K.) having the average primary particle diameter of 23 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

(Production of Silica Particles A)

A mixed solution was obtained by mixing 700 parts of methanol, 46 parts of water, and 55 parts of a 25% by mass ammonia aqueous solution. Next, the mixed solution was heated to 35° C., and 1,300 parts of tetramethoxy silane, and 470 parts of 5.3% by mass ammonia aqueous solution were simultaneously started to be added dropwise to the mixed solution with stirring at 3,500 rpm. The dripping of the tetramethoxy silane and the ammonia aqueous solution were performed for 7 hours and 4 hours, respectively. Thereafter, the mixture was stirred for 0.5 hours, to thereby obtain a suspension of silica particles. To the suspension, 550 parts of hexamethyl disilazane was further added at room temperature, and the resulting mixture was heated to 55° C. and reacted for 3 hours, to thereby obtain Silica Particles A having the average primary particle diameter of 170 nm.

Example 2

A toner of Example 2 was obtained in the same manner as in Example 1, provided that the first silica particles were changed to Silica Particles A, and the amount of the second silica particles added was changed to 2.8 parts.

Example 3

A toner of Example 3 was obtained in the same manner as in Example 1, provided that the amount of the first silica particles added was changed to 3.8 parts, and the second silica particles were changed to RX50 (manufactured by Nippon Aerosil Co., Ltd.) having the average primary particle diameter of 40 nm.

Example 4

Base Particles A (100 parts), 3.8 parts of Silica Particles A as first silica particles, 2.8 parts of second silica particles RX50 (manufactured by Nippon Aerosil Co., Ltd.) having the average primary particle diameter of 40 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Example 5

A toner of Example 5 was obtained in the same manner as in Example 1, provided that the first silica particles were changed to UFP-35H (manufactured by DENKI KAGAKU KOGYO KABUSHIKI KAISHA) having the average primary particle diameter of 78 nm, and the second silica particles were changed to HDK/2000H (manufactured by Clariant Japan K.K.) having the average primary particle diameter of 19 nm.

Example 6

Base Particles A (100 parts), 3.8 parts of first silica particles UFP-35H (manufactured by DENKI KAGAKU KOGYO KABUSHIKI KAISHA) having the average primary particle diameter of 78 nm, 0.6 parts of second silica particles TG-C413 (manufactured by Cabot Corporation) having the average primary particle diameter of 50 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

(Production of Silica Particles B)

From a center of a two-fluid nozzle for spraying slurry, which was provided in a center part of a burner, slurry composed of 50 parts by mass of metal silicon powder having the average particle diameter of 6.7 and 50 parts of water was ejected into a flame of about 1,800° C. at 12.3 kg/h as well as supplying oxygen from the surrounding area thereof, to thereby generate a spherical silica powder. Next, the spherical silica powder was transported through pneumatic transportation to a collection line by means of a blower, and then was collected with a bag filter.

After charging a vibrating fluid bed with 250 g of the spherical silica powder, 3.2 g of water was sprayed with fluidizing the spherical silica powder with air circulated by a suction blower, to thereby flow mix for 5 minutes. Next, 5.3 g of hexamethyl disilazane was sprayed, and the resulting mixture was flow mixed for 40 minutes, to thereby obtain Silica Particle B having the average primary particle diameter of 250 nm.

Example 7

Base Particles A (100 parts), 1.1 parts of Silica Particles B as first silica particles, 2.8 parts of second silica particles HDK/2000H (manufactured by Clariant Japan K.K.) having the average primary particle diameter of 19 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Example 8

Base Particles A (100 parts), 3.8 parts of Silica Particles B as first silica particles, 2.8 parts of second silica particles TG-C413 (manufactured by Cabot Corporation) having the average primary particle diameter of 50 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Example 9

A toner of Example 9 was obtained in the same manner as in Example 1, provided that the second silica particles were changed to HDK/2000H (manufactured by Clariant Japan K.K.) having the average primary particle diameter of 19 nm.

Example 10

A toner of Example 10 was obtained in the same manner as in Example 1, provided that the first silica particles were changed to Silica Particles A, and the second silica particles were changed to TG-C413 (manufactured by Cabot Corporation) having the average primary particle diameter of 50 nm.

Example 11

Base Particles A (100 parts), 3.8 parts of first silica particles X-24 (manufactured by Shin-Etsu Chemical Co., Ltd.) having the average primary particle diameter of 120 nm, 2.8 parts of second silica particles HDK/2000H (manufactured by Clariant Japan K.K.) having the average primary particle diameter of 19 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Example 12

Base Particles A (100 parts), 3.8 parts of Silica Particles A as first silica particles, 2.8 parts of second silica particles TG-C413 (manufactured by Cabot Corporation) having the average primary particle diameter of 50 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Example 13

A toner of Example 13 was obtained in the same manner as in Example 1, provided that the first silica particles were changed to UFP-35H (manufactured by DENKI KAGAKU KOGYO KABUSHIKI KAISHA) having the average primary particle diameter of 78 nm, and the second silica particles were changed to H1303VP (manufactured by Clariant Japan K.K.) having the average primary particle diameter of 23 nm.

Example 14

A toner of Example 14 was obtained in the same manner as in Example 13, provided that the amount of the first silica particles added was changed to 3.8 parts, and the amount of the second silica particles added was changed to 2.8 parts.

Example 15

A toner of Example 15 was obtained in the same manner as in Example 1, provided that the first silica particles were changed to Silica Particles B, and the second silica particles were changed to RX50 (manufactured by Nippon Aerosil Co., Ltd.) having the average primary particle diameter of 40 nm.

Example 16

A toner of Example 16 was obtained in the same manner as in Example 15, provided that the amount of the first silica particles added was changed to 3.8 parts, and the amount of the second silica particles added was changed to 2.8 parts.

(Production of Base Particles B)

—Synthesis of Polyester Prepolymer—

A reaction vessel equipped with a cooling tube, a stirrer, and a nitrogen-inlet tube was charged with 682 parts of bisphenol A ethylene oxide (2 mol) adduct, 81 parts of bisphenol A propylene oxide (2 mol) adduct, 283 parts of terephthalic acid, 22 parts of trimellitic anhydride, and 2 parts of dibutyl tin oxide. The mixture was then allowed to react for 8 hours at 230° C., followed by further reacting for 6 hours under the reduced pressure of 10 mmHg to 15 mmHg, to thereby obtain Polyester 2 having a hydroxyl group. Polyester 2 having a hydroxyl group had the number average molecular weight of 2,100, weight average molecular weight of 9,000, glass transition temperature of 58° C., acid value of 0.5 mgKOH/g, and hydroxyl value of 51 mgKOH/g.

Next, a reaction vessel equipped with a cooling tube, a stirrer, and a nitrogen-inlet tube was charged with 410 parts of Polyester 2 having a hydroxyl group, 89 parts of isophorone diisocyanate, and 500 parts of ethyl acetate, and the resulting mixture was allowed to react for 5 hours at 100° C., to thereby obtain Polyester Prepolymer 2.

—Emulsification and Removal of Solvent—

A vessel was charged with 664 parts of Pigment-Wax Dispersion Liquid 1, 109.4 parts of Polyester Prepolymer 1, and 4.6 parts of Ketimine 1, and the resulting mixture was mixed for 1 minute at 5,000 rpm by means of a TK homomixer (manufactured by Tokushu Kika Kogyo Co., Ltd.). To the resultant, 1,200 parts of Aqueous Medium 1 was added, followed by mixing the mixture for 5 minutes at 11,000 rpm by means of the TK homomixer, to thereby obtain Emulsified Slurry 2.

A vessel equipped with a stirrer and a thermometer was charged with Emulsified Slurry 2, and the solvent therein was removed at 30° C. for 8 hours. The resultant was then aged for 4 hours at 45° C., to thereby obtain Dispersion Slurry 2.

—Washing and Drying—

Dispersion Slurry 2 (100 parts) was subjected to vacuum filtration. To the filtration cake, 100 parts of ion-exchanged water was added, and the resulting mixture was mixed for 10 minutes at 12,000 rpm by means of the TK homomixer, followed by filtering the mixture. After further adding 100 parts of a 10% by mass sodium hydroxide aqueous solution to the filtration cake, the mixture was mixed for 30 minutes at 12,000 rpm by the TK homomixer, followed by subjecting the mixture to vacuum filtration. Next, to the resulting filtration cake, 100 parts of 10% by mass hydrochloric acid was added, and the mixture was then mixed for 10 minutes at 12,000 rpm by the TK homomixer, followed by filtering the mixture. After adding 300 parts of ion-exchanged water to the filtration cake, the mixture was mixed for 10 minutes at 12,000 rpm by the TK homomixer, followed by filtering the mixture. This series of operations was performed twice.

The resulting filtration cake was dried for 48 hours at 45° C. by means of an air-circulating drier, followed by sieving the resultant with a mesh having an opening size of 75 μm, to thereby obtain Base Particles B.

Examples 17 to 32

Toners of Examples 17 to 32 were produced in the same manner as in Examples 1 to 16, respectively, provided that Base Particles A were changed to Base Particles B.

(Production of Base Particles C)

Styrene (71 parts), 25 parts of n-butyl acrylate, and 4 parts of acrylic acid were mixed to thereby obtain a monomer mixture liquid.

A reaction vessel was charged with 100 parts of water, 1 part of a nonionic surfactant EMULGEN 950 (manufactured by Kao Corporation), and 1.5 parts of an anionic surfactant NEOGEN R (manufactured by DAI-ICHI KOGYO SEIYAKU CO., LTD.), and the resulting mixture was heated to 70° C. To the mixture, the monomer mixture liquid, and 5 parts of a 1% by mass potassium persulfate aqueous solution were both added dropwise for 4 hours, and the resulting mixture was allowed to react for 2 hours at 70° C., to thereby obtain Resin Particle Dispersion Liquid 2 having a solid content of 50% by mass.

Carbon black Printex 35 (manufactured by Degussa) (20 parts), 1 part of a salicylic acid metal complex E-84 (manufactured by Orient Chemical Industries, Ltd.), 0.5 parts of an anionic surfactant NEOGEN R (manufactured by DAI-ICHI KOGYO SEIYAKU CO., LTD.) and 310 parts of water were dispersed for 2 hours at 25° C. by means of a disperser. To the resultant, 88 parts of Resin Particle Dispersion Liquid 2 was added, and the resulting mixture was stirred for 2 hours. The resultant was heated to 60° C., followed by adding ammonium to the mixture to adjust pH thereof to 7.0. Next, the resultant was heated to 90° C., and the temperature was maintained for 2 hours, to thereby obtain Dispersion Slurry 3.

Dispersion Slurry 3 (100 parts) was subjected to vacuum filtration. To the filtration cake, 100 parts of ion-exchanged water was added, and the resulting mixture was mixed for 10 minutes at 12,000 rpm by means of the TK homomixer (manufactured by Tokushu Kika Kogyo Co., Ltd.), followed by filtering the mixture. After further adding a 10% by mass hydrochloric acid aqueous solution to the filtration cake to adjust pH thereof to 2.8, the mixture was mixed for 10 minutes at 12,000 rpm by means of the TK homomixer, followed by filtering the mixture. Next, 300 parts of ion-exchanged water was added to the filtration cake, and the mixture was mixed for 10 minutes at 12,000 rpm by the TK homomixer, followed by filtering the mixture. This series of operations was performed twice.

The resulting filtration cake was dried for 48 hours at 45° C. by means of an air-circulating drier, followed by sieving the resultant with a mesh having an opening size of 75 to thereby obtain Base Particles C.

Examples 33 to 48

Toners of Examples 33 to 48 were obtained in the same manner as in Examples 1 to 16, respectively, provided that Base Particles A were changed to Base Particles C.

(Production of Base Particles D)

—Synthesis of Non-Crystalline Polyester—

A reaction vessel equipped with a thermometer, a stirrer, a cooling tube, and a nitrogen-inlet tube was charged with 443 parts of bisphenol A propylene oxide adduct having a hydroxyl value of 320 mgKOH/g, 135 parts of diethylene glycol, 211 parts of terephthalic acid, 211 parts of fumaric acid, and 2.5 parts of dibutyl tin oxide, and the resulting mixture was allowed to react at 150° C. to 180° C., to thereby obtain Non-Crystalline Polyester 2.

—Preparation of Master Batch—

Water (25 parts), 50 parts of copper phthalocyanine (manufactured by TOYO INK CO., LTD.), and 100 parts of Non-Crystalline Polyester 2 were mixed with HENSCHEL MIXER, HENSCHEL 20B (manufactured by Mitsui Mining Co., Ltd.) for 3 minutes at 1,500 rpm, followed by kneading the mixture with a two-roll mill for 45 minutes at 120° C. Next, the kneaded product was rolled and cooled, followed by pulverizing the resultant by means of a pluverizer, to thereby obtain Master Batch 2.

—Kneading—

Non-Crystalline Polyester 2 (51 parts), 5 parts of paraffin wax HNP-11 (manufactured by NIPPON SEIRO CO., LTD.), and 8 parts of Master Batch 2 were mixed by means of HENSCHEL MIXER, HENSCHEL 20B (manufactured by Mitsui Mining Co., Ltd.) for 3 minutes at 1,500 rpm. Next, the mixture was kneaded by means of a monoaxisual kneader, Small Buss Cokneader (manufactured by Buss), followed by rolling and cooling the kneaded product, to thereby obtain Base Intermediate Product D. In this process, the set temperature of the inlet part of the monoaxial kneader was 90° C., the set temperature of the outlet part thereof was 60° C., and the feeding rate thereof was set to 10 kg/h.

—Pulverizing—

After roughly pulverizing Base Intermediate Product D by means of a pluverizer (manufactured by Hosokawa Micron Corporation), the resultant was finely pulverized using a flat crush plate of 1-type mill IDS-2 (manufactured by Nippon Pneumatic Mfg. Co., Ltd.) with the air pressure of 6.0 atm/cm$^2$, at the feeding rate of 0.5 kg/h. Next, the resultant was classified by means of air classifier Microplex 132 MP (product of Alpine), to thereby obtain Base Particles D.

(Examples 49 to 64)

Toners of Examples 49 to 64 were obtained in the same manner as in Examples 1 to 16, respectively, provided that Base Particles A were changed to Base Particles D.

Comparative Example 1

A toner of Comparative Example 1 was obtained in the same manner as in Example 1, provided that the amount of the first silica particles added was changed to 0.8 parts, and the amount of the second silica added was changed to 0.3 parts.

Comparative Example 2

Base Particles B (100 parts), 0.8 parts of Silica Particles A as first silica particles, 3.5 parts of second silica particles RX50 (manufactured by Nippon Aerosil Co., Ltd.) having the average primary particle diameter of 40 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Comparative Example 3

Base Particles C (100 parts), 4.2 parts of first silica particles X-24 (manufactured by Shin-Etsu Chemical Co., Ltd.) having the average primary particle diameter of 120 nm, 0.3 parts of second silica particles H1303VP (manufactured by Clariant Japan K.K.) having the average primary particle diameter of 23 nm, and 1.0 part of titanium oxide JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Comparative Example 4

Base Particles D (100 parts), 4.2 parts of Silica Particles A as first silica particles, 3.5 parts of second silica particles RX50 (manufactured by Nippon Aerosil Co., Ltd.) having the average primary particle diameter of 40 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Comparative Example 5

Base Particles A (100 parts), 0.8 parts of Silica Particles A as first silica particles, 0.6 parts of second silica particles H1303VP (manufactured by Clariant Japan K.K.) having the average primary particle diameter of 23 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Comparative Example 6

Base Particles B (100 parts), 0.8 parts of first silica particles X-24 (manufactured by Shin-Etsu Chemical Co., Ltd.) having the average primary particle diameter of 120 nm, 2.8 parts of second silica particles RX50 (manufactured by Nippon Aerosil Co., Ltd.) having the average primary particle diameter of 40 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Comparative Example 7

Base Particles C (100 parts), 4.2 parts of Silica Particles A as first silica particles, 0.6 parts of second silica particles H1303VP (manufactured by Clariant Japan K.K.) having the average primary particle diameter of 23 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Comparative Example 8

Base Particles D (100 parts), 4.2 parts of first silica particles X-24 (manufactured by Shin-Etsu Chemical Co., Ltd.) having the average primary particle diameter of 120 nm, 2.8 parts of second silica particles RX50 (manufactured by Nippon Aerosil Co., Ltd.) having the average primary particle diameter of 40 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the titanium oxide particles were added and mixed for 10 minutes at a second stage, and the second silica particles were added and mixed for 10 minutes at a third stage. The resultant was sieved with a 500-mesh, to thereby obtain a toner.

Comparative Example 9

A toner of Comparative Example 9 was obtained in the same manner as in Comparative Example 1, provided that the amount of the first silica particles added was changed to 1.1 parts.

Comparative Example 10

A toner of Comparative Example 10 was obtained in the same manner as in Comparative Example 2, provided that the amount of the first silica particles added was changed to 1.1 parts.

Comparative Example 11

A toner of Comparative Example 11 was obtained in the same manner as in Comparative Example 3, provided that the amount of the first silica particles added was changed to 3.8 parts.

Comparative Example 12

A toner of Comparative Example 12 was obtained in the same manner as in Comparative Example 4, provided that the amount of the first silica particles added was changed to 3.8 parts.

Comparative Example 13

A toner of Comparative Example 13 was obtained in the same manner as in Comparative Example 5, provided that the amount of the first silica particles added was changed to 1.1 parts, and only the first silica particles were added and mixed for 10 minutes at the first stage, the second silica particles were added and mixed for 10 minutes at the second stage, and the titanium oxide particles were added and mixed for 10 minutes at the third stage.

Comparative Example 14

Base Particles B (100 parts), 1.1 parts of first silica particles X-24 (manufactured by Shin-Etsu Chemical Co., Ltd.) having the average primary particle diameter of 120 nm, 0.6 parts of second silica particles RX50 (manufactured by Nippon Aerosil Co., Ltd.) having the average primary particle diameter of 40 nm, and 1.0 part of titanium oxide particles JMT-150IB (manufactured by TAYCA CORPORATION) having the average primary particle diameter of 20 nm were mixed by means of HENSCHEL MIXER. Specifically, only the first silica particles were added and mixed for 10 minutes at a first stage, the second silica particles were added and mixed for 10 minutes at a second stage, and the titanium oxide particles were added and mixed for 10 minutes at a third stage. The resultant was sieved with a 500-mesh, to thereby obtain a toner.

Comparative Example 15

A toner of Comparative Example 15 was obtained in the same manner as in Comparative Example 3, provided that the amount of the first silica particles added was changed to 3.8 parts, the amount of the second silica particles added was changed to 2.8 parts, only the titanium oxide particles were added and mixed for 10 minutes at the first stage, the second silica particles were added and mixed for 10 minutes at the second stage, and the first silica particles were added and mixed for 10 minutes at the third stage.

Comparative Example 16

A toner of Comparative Example 16 was obtained in the same manner as in Comparative Example 4, provided that the amount of the first silica particles added was changed to 3.8 parts, the amount of the second silica particles added was changed to 2.8 parts, only the titanium oxide particles were added and mixed for 10 minutes at the first stage, the second silica particles were added and mixed for 10 minutes at the second stage, and the first silica particles were added and mixed for 10 minutes at the third stage.

Comparative Example 17

A toner of Comparative Example 17 was obtained in the same manner as in Comparative Example 1, provided that the amount of the first silica particles added was changed to 1.1 parts, the amount of the second silica particles was changed to 2.8 parts, and the mixing time of each of the first stage, second stage, and third stage was changed to 3 minutes.

Comparative Example 18

A toner of Comparative Example 18 was obtained in the same manner as in Comparative Example 6, provided that the amount of the first silica particles added was changed to 1.1 parts, and the mixing time of each of the first stage, second stage, and third stage was changed to 5 minutes.

Comparative Example 19

A toner of Comparative Example 19 was obtained in the same manner as in Comparative Example 3, provided that the amount of the first silica particles added was changed to 3.8 parts, the amount of the second silica particles added was changed to 2.8 parts, only the titanium oxide particles were added and mixed for 10 minutes at the first stage, the first silica particles were added and mixed for 10 minutes at the second stage, and the second silica particles were added and mixed for 10 minutes at the third stage.

Comparative Example 20

A toner of Comparative Example 20 was obtained in the same manner as in Comparative Example 8, provided that the amount of the first silica particles added was changed to 3.8 parts, only the titanium oxide particles were added and mixed at the first stage, the first silica particles were added and mixed at the second stage, the second silica particles were added and mixed at the third stage, and the mixing time of each of the first stage, second stage, and third stage was changed to 3 minutes.

Comparative Example 21

A toner of Comparative Example 21 was obtained in the same manner as in Example 1, provided that the first silica particles were changed to first silica particles having the average primary particle diameter of 260 nm, the second silica particles were changed to RX50 (manufactured by Nippon Aerosil Co., Ltd.) having the average primary particle diameter of 40 nm, and the amount of the second silica particles added was changed to 2.8 parts.

Comparative Example 22

A toner of Comparative Example 22 was obtained in the same manner as in Example 1, provided that the first silica particles were changed to the Silica Particles A, the second silica particles were changed to silica particles having the average primary particle diameter of 8 nm, and the amount of the second silica particles added was changed to 2.8 parts.

Comparative Example 23

A toner of Comparative Example 23 was obtained in the same manner as in Example 1, provided that the first silica particles were changed to first silica particles having the average primary particle diameter of 60 nm, the amount of the first silica particles added was changed to 3.8 parts, and the second silica particles were not added.

The properties of each toner are presented in Tables 1 to 3. Note that, the mass ratio in the tables denotes a mass ratio with respect to the base particles.

TABLE 1

| | | First silica particles | | Second silica particles | | Ultrasonic vibration method | |
|---|---|---|---|---|---|---|---|
| | Base particles | Average primary particle diameter [nm] | Mass ratio | Average primary particle diameter [nm] | Mass ratio | Xs [mass %] | R30 [number %] |
| Ex. 1 | A | 120 | 0.011 | 23 | 0.006 | 9 | 15 |
| Ex. 2 | A | 170 | 0.011 | 23 | 0.028 | 12 | 17 |
| Ex. 3 | A | 120 | 0.038 | 40 | 0.006 | 10 | 9 |
| Ex. 4 | A | 170 | 0.038 | 40 | 0.028 | 11 | 8 |
| Ex. 5 | A | 78 | 0.011 | 19 | 0.006 | 5 | 18 |
| Ex. 6 | A | 78 | 0.038 | 50 | 0.006 | 8 | 8 |
| Ex. 7 | A | 250 | 0.011 | 19 | 0.028 | 12 | 20 |
| Ex. 8 | A | 250 | 0.038 | 50 | 0.028 | 15 | 6 |
| Ex. 9 | A | 120 | 0.011 | 19 | 0.006 | 7 | 20 |

TABLE 1-continued

| | | First silica particles | | Second silica particles | | Ultrasonic vibration method | |
|---|---|---|---|---|---|---|---|
| | Base particles | Average primary particle diameter [nm] | Mass ratio | Average primary particle diameter [nm] | Mass ratio | Xs [mass %] | R30 [number %] |
| Ex. 10 | A | 170 | 0.011 | 50 | 0.006 | 8 | 6 |
| Ex. 11 | A | 120 | 0.038 | 19 | 0.028 | 6 | 19 |
| Ex. 12 | A | 170 | 0.038 | 50 | 0.028 | 12 | 7 |
| Ex. 13 | A | 78 | 0.011 | 23 | 0.006 | 5 | 12 |
| Ex. 14 | A | 78 | 0.038 | 23 | 0.028 | 5 | 14 |
| Ex. 15 | A | 250 | 0.011 | 40 | 0.006 | 13 | 9 |
| Ex. 16 | A | 250 | 0.038 | 40 | 0.028 | 15 | 7 |
| Ex. 17 | B | 120 | 0.011 | 23 | 0.006 | 11 | 16 |
| Ex. 18 | B | 170 | 0.011 | 23 | 0.028 | 14 | 18 |
| Ex. 19 | B | 120 | 0.038 | 40 | 0.006 | 13 | 9 |
| Ex. 20 | B | 170 | 0.038 | 40 | 0.028 | 12 | 9 |
| Ex. 21 | B | 78 | 0.011 | 19 | 0.006 | 6 | 17 |
| Ex. 22 | B | 78 | 0.038 | 50 | 0.006 | 10 | 7 |
| Ex. 23 | B | 250 | 0.011 | 19 | 0.028 | 12 | 20 |
| Ex. 24 | B | 250 | 0.038 | 50 | 0.028 | 17 | 9 |
| Ex. 25 | B | 120 | 0.011 | 19 | 0.006 | 9 | 19 |
| Ex. 26 | B | 170 | 0.011 | 50 | 0.006 | 11 | 8 |
| Ex. 27 | B | 120 | 0.038 | 19 | 0.028 | 8 | 18 |
| Ex. 28 | B | 170 | 0.038 | 50 | 0.028 | 14 | 8 |
| Ex. 29 | B | 78 | 0.011 | 23 | 0.006 | 7 | 11 |
| Ex. 30 | B | 78 | 0.038 | 23 | 0.028 | 8 | 14 |
| Ex. 31 | B | 250 | 0.011 | 40 | 0.006 | 15 | 10 |
| Ex. 32 | B | 250 | 0.038 | 40 | 0.028 | 17 | 7 |

TABLE 2

| | | First silica particles | | Second silica particles | | Ultrasonic vibration method | |
|---|---|---|---|---|---|---|---|
| | Base particles | Average primary particle diameter [nm] | Mass ratio | Average primary particle diameter [nm] | Mass ratio | Xs [mass %] | R30 [number %] |
| Ex. 33 | C | 120 | 0.011 | 23 | 0.006 | 12 | 14 |
| Ex. 34 | C | 170 | 0.011 | 23 | 0.028 | 14 | 18 |
| Ex. 35 | C | 120 | 0.038 | 40 | 0.006 | 13 | 10 |
| Ex. 36 | C | 170 | 0.038 | 40 | 0.028 | 13 | 9 |
| Ex. 37 | C | 78 | 0.011 | 19 | 0.006 | 7 | 15 |
| Ex. 38 | C | 78 | 0.038 | 50 | 0.006 | 12 | 8 |
| Ex. 39 | C | 250 | 0.011 | 19 | 0.028 | 13 | 20 |
| Ex. 40 | C | 250 | 0.038 | 50 | 0.028 | 17 | 8 |
| Ex. 41 | C | 120 | 0.011 | 19 | 0.006 | 10 | 20 |
| Ex. 42 | C | 170 | 0.011 | 50 | 0.006 | 12 | 10 |
| Ex. 43 | C | 120 | 0.038 | 19 | 0.028 | 9 | 18 |
| Ex. 44 | C | 170 | 0.038 | 50 | 0.028 | 14 | 9 |
| Ex. 45 | C | 78 | 0.011 | 23 | 0.006 | 7 | 12 |
| Ex. 46 | C | 78 | 0.038 | 23 | 0.028 | 9 | 14 |
| Ex. 47 | C | 250 | 0.011 | 40 | 0.006 | 14 | 11 |
| Ex. 48 | C | 250 | 0.038 | 40 | 0.028 | 17 | 9 |
| Ex. 49 | D | 120 | 0.011 | 23 | 0.006 | 16 | 15 |
| Ex. 50 | D | 170 | 0.011 | 23 | 0.028 | 18 | 15 |
| Ex. 51 | D | 120 | 0.038 | 40 | 0.006 | 16 | 9 |
| Ex. 52 | D | 170 | 0.038 | 40 | 0.028 | 17 | 9 |
| Ex. 53 | D | 78 | 0.011 | 19 | 0.006 | 10 | 19 |
| Ex. 54 | D | 78 | 0.038 | 50 | 0.006 | 14 | 7 |
| Ex. 55 | D | 250 | 0.011 | 19 | 0.028 | 18 | 20 |
| Ex. 56 | D | 250 | 0.038 | 50 | 0.028 | 20 | 8 |
| Ex. 57 | D | 120 | 0.011 | 19 | 0.006 | 14 | 19 |
| Ex. 58 | D | 170 | 0.011 | 50 | 0.006 | 14 | 6 |
| Ex. 59 | D | 120 | 0.038 | 19 | 0.028 | 13 | 18 |
| Ex. 60 | D | 170 | 0.038 | 50 | 0.028 | 18 | 8 |

TABLE 2-continued

| | Base particles | First silica particles: Average primary particle diameter [nm] | First silica particles: Mass ratio | Second silica particles: Average primary particle diameter [nm] | Second silica particles: Mass ratio | Ultrasonic vibration method: Xs [mass %] | Ultrasonic vibration method: R30 [number %] |
|---|---|---|---|---|---|---|---|
| Ex. 61 | D | 78 | 0.011 | 23 | 0.006 | 9 | 14 |
| Ex. 62 | D | 78 | 0.038 | 23 | 0.028 | 13 | 13 |
| Ex. 63 | D | 250 | 0.011 | 40 | 0.006 | 19 | 10 |
| Ex. 64 | D | 250 | 0.038 | 40 | 0.028 | 20 | 7 |

TABLE 3

| | Base particles | First silica particles: Average primary particle diameter [nm] | First silica particles: Mass ratio | Second silica particles: Average primary particle diameter [nm] | Second silica particles: Mass ratio | Ultrasonic vibration method: Xs [mass %] | Ultrasonic vibration method: R30 [number %] |
|---|---|---|---|---|---|---|---|
| Comp. Ex. 1 | A | 120 | 0.008 | 23 | 0.003 | 6 | 8 |
| Comp. Ex. 2 | B | 170 | 0.008 | 40 | 0.035 | 8 | 14 |
| Comp. Ex. 3 | C | 120 | 0.042 | 23 | 0.003 | 10 | 9 |
| Comp. Ex. 4 | D | 170 | 0.042 | 40 | 0.035 | 18 | 12 |
| Comp. Ex. 5 | A | 170 | 0.008 | 23 | 0.006 | 8 | 18 |
| Comp. Ex. 6 | B | 120 | 0.008 | 40 | 0.028 | 10 | 14 |
| Comp. Ex. 7 | C | 170 | 0.042 | 23 | 0.006 | 12 | 13 |
| Comp. Ex. 8 | D | 120 | 0.042 | 40 | 0.028 | 17 | 15 |
| Comp. Ex. 9 | A | 120 | 0.011 | 23 | 0.003 | 6 | 16 |
| Comp. Ex. 10 | B | 170 | 0.011 | 40 | 0.035 | 9 | 9 |
| Comp. Ex. 11 | C | 120 | 0.038 | 23 | 0.003 | 9 | 12 |
| Comp. Ex. 12 | D | 170 | 0.038 | 40 | 0.035 | 19 | 11 |
| Comp. Ex. 13 | A | 170 | 0.011 | 23 | 0.006 | 4 | 14 |
| Comp. Ex. 14 | B | 120 | 0.011 | 40 | 0.006 | 3 | 18 |
| Comp. Ex. 15 | C | 120 | 0.038 | 23 | 0.028 | 22 | 20 |
| Comp. Ex. 16 | D | 170 | 0.038 | 40 | 0.028 | 25 | 14 |
| Comp. Ex. 17 | A | 120 | 0.011 | 23 | 0.028 | 12 | 29 |
| Comp. Ex. 18 | B | 120 | 0.011 | 40 | 0.028 | 14 | 25 |
| Comp. Ex. 19 | C | 120 | 0.038 | 23 | 0.028 | 11 | 25 |
| Comp. Ex. 20 | D | 120 | 0.038 | 40 | 0.028 | 16 | 32 |
| Comp. Ex. 21 | A | 260 | 0.011 | 40 | 0.028 | 15 | 16 |
| Comp. Ex. 22 | A | 170 | 0.011 | 8 | 0.028 | 7 | 7 |
| Comp. Ex. 23 | A | 60 | 0.038 | — | — | 12 | 10 |

(Liberation Ratio of Silica Particles)

A 500 mL beaker was charged with 10 g of polyoxyalkylene alkyl ether, NOIGEN ET-165 (manufactured by DAI-ICHI KOGYO SEIYAKU CO., LTD.), and 300 mL of pure water, followed by dispersing the mixture with ultrasonic waves for 1 hour, to thereby obtain Dispersion Liquid A. Next, Dispersion Liquid A was transferred into a 2 L measuring flask and diluted, followed by dispersing for 1 hour with ultrasonic waves, to thereby obtain Dispersion Liquid B having a solid content of 0.5% by mass.

After placing 50 mL of Dispersion Liquid B in a 110 mL screw-cap tube, 3.75 g of a toner was added and the resultant was stirred for 30 minutes to 90 minutes until the screw-cap tube was adjusted to the dispersion liquid.

After sufficiently dispersing the toner, the vibration part was placed into the dispersion liquid by 2.5 cm by means of a 750 W ultrasonic homogenizer VCX750 (manufactured by Sonics & Materials, Inc.) to vibrate for 1 minute.

The resulting dispersion liquid was placed in a 50 mL centrifuge tube, followed by subjecting the dispersion liquid to centrifugal separation for 2 minutes with 2,000 rotations. While washing the sediments with 60 mL of pure water, the sediments was poured into Sepa-rohto to thereby perform vacuum filtration.

The filtered product was placed in a small cap, followed by adding 60 mL of pure water to the small cap. The mixture was stirred 5 times with a handle of a spatula.

The resultant was again subjected to vacuum filtration, and the resulting filtered product was collected and dried in a constant-temperature bath of 40° C. for 8 hours. The dried filtered product (3 g) was formed into a pellet having a diameter of 3 mm and a thickness of 2 mm by means of an automatic briquetting press machine T-BRB-32 (manufactured by Maekawa Testing Machine Mfg. Co., Ltd.) with the load of 6.0 t, and the compress time of 60 seconds, to thereby prepare a toner after the processing.

A toner, to which the aforementioned processing was not performed, was formed into a pellet having a diameter of 3 mm and a thickness of 2 mm in the same manner as the above, to thereby prepare a toner before the processing.

An amount (part(s)) of the silica particles in the toner was measured by means of X-ray fluorescence spectrometer ZSX-100e (manufactured by Rigaku Corporation). For the measurement, a calibration curve had been prepared in advance using toners whose silica particles contents were respectively 0.1 parts, 1 part, and 1.8 parts, and a liberation ratio Xs [% by mass] of the silica particles was calculated by the following formula:

$$Xs=\{(\text{amount [part(s)] of silica particles in toner before processing})-(\text{amount [part(s)] of silica particles in toner after processing})\}/(\text{amount [part(s)] of silica particles in toner before processing})\times 100$$

(Particle Size distribution of Librated Silica Particles)

The filtrate obtained by the first vacuum filtration was dispersed by means of the ultrasonic homogenizer for 30 seconds at 30 W, followed by subjecting the resultant to the measurement of the particle size distribution by means of UPA-EX150 (manufactured by NIKKISO CO., LTD.). During the measurement, the surrounding environment was set to 23° C./50% RH, the refractive index of the solvent was 1.333, the refractive index of the particles was 1.45, the channel number was 52, the measuring time was 60 seconds, the shapes of the particles were non-spherical shape, and the loading index was 0.200 to 0.300. The accumulated total [% by number] of the frequency of the particles having particle diameters of 30 nm or smaller, which was represented with the channel 32.

Next, filming of silica, low temperature fixing ability, heat resistant storage stability, and transfer stability were evaluated.

(Filming of Silica)

A toner and a photocopier were left to stand in a room having the environment of 25° C., 50% RH for 1 day. Next, all the toner of PCU of the photocopier Imagio neo C6000 (manufactured by Ricoh Company Limited) was removed, and only carrier was left in the developing apparatus. Into the developing apparatus, in which only the carrier was present, 28 g of the toner was added, to thereby produce 400 g of a developer having a toner concentration of 7% by mass. The developing apparatus was mounted in the main body of the photocopier, only the developing apparatus was operated for 5 minutes with driving the developing sleeve at the linear speed of 300 mm/s. The photoconductor and the developing sleeve were each rotated at linear speed of 352 mm/s, and 430 mm/s, respectively, with trailing. The charging electric potential and developing bias were adjusted so that the amount of the toner on the photoconductor to be 0.4 $mg/cm^2 \pm 0.05$ $mg/cm^2$. With the aforementioned developing conditions, transfer current was adjusted so that the transfer rate was to be 96%±2%. A solid image on an entire sheet was printed to continuously output 10,000 sheets. The image quality of the output image was subjected to organoleptic evaluation. A number of white missing areas formed by filming was counted. As for the carrier, carrier, which had been installed in the photocopier, was used. Note that, a case where there was less white missing area was judged as "A," a case where white missing areas were rarely observed was judged as "B", a case where white missing areas were notable was judged as "C," and a case where there were significantly many white missing areas was judged as "D."

(Low Temperature Fixing Ability)

By means of a modified device of an electrophotographic photocopier (MF2200, manufactured by Ricoh Company Limited) whose fixing unit had been modified to use a Teflon (registered trade mark) roller, printing was performed on Type 6200 paper (manufactured by Ricoh Company Limited). Specifically, the minimum fixing temperature was determined with varying fixing temperature. As for the evaluation conditions of the minimum fixing temperature, a linear speed of paper feeding was 120 mm/s to 150 mm/s, bearing was 1.2 $kgf/cm^2$, and nip width was 3 mm. Note that, a case where the minimum fixing temperature was lower than 120° C. was judged as "A," a case where the minimum fixing temperature was 120° C. or higher but lower than 130° C. was judged as "B," a case where the minimum fixing temperature was 130° C. or higher but lower than 140° C. was judged as "C," and a case where the minimum fixing temperature was 140° C. or higher was judged as "D."

(Heat Resistant Storage Stability)

After storing the toner in the environment having the temperature of 40° C. and the relative humidity of 70% RH for 14 days, the toner was sieved with a sieve having a mesh size of 200 for 1 minute, and a remaining rate of the toner on the mesh was measured. Note that, a case where the remaining rate was less than 0.1% was judged as "A," a case where the remaining rate was 0.1% or greater but less than 0.5% was judged as "B," a case where the remaining rate was 0.5% or greater but less than 1% was judged as "C," and a case where the remaining rate was 1% or greater was judged as "D."

(Transfer Stability)

By means of a photocopier Imagio neo C6000 (manufactured by Ricoh Company Limited), a chart having an imaging area of 20% was transferred from a photoconductor to paper. Thereafter, the residual toner on the photoconductor just before cleaning was transferred to white paper with Scotch Tape (manufactured by Sumitomo 3M Ltd.), and the resultant was measured by Macbeth reflection densitometer RD514. Note that, a case where a difference with blank was less than 0.005 was judged as "A," a case where a difference with blank was 0.005 or greater but less than 0.010 was judged as "B," a case where a difference with blank was 0.010 or greater but less than 0.020 was judged as "C," and a case where a difference with blank was 0.020 or greater was judged as "D."

The evaluation results of the aforementioned items (i.e., filming of silica, low temperature fixing ability, heat resistant storage stability, and transfer stability) are presented in Tables 4 to 6.

TABLE 4

| | Filming of silica | Low temperature fixing ability | Heat resistant storage stability | Transfer stability |
|---|---|---|---|---|
| Ex. 1 | A | A | B | B |
| Ex. 2 | A | A | B | B |
| Ex. 3 | A | A | A | A |
| Ex. 4 | A | A | A | A |
| Ex. 5 | B | A | B | B |
| Ex. 6 | B | A | B | B |
| Ex. 7 | B | A | A | A |
| Ex. 8 | B | A | A | A |
| Ex. 9 | B | A | B | B |
| Ex. 10 | A | A | B | B |
| Ex. 11 | B | A | A | A |
| Ex. 12 | A | A | A | A |
| Ex. 13 | A | A | B | B |
| Ex. 14 | A | A | B | B |
| Ex. 15 | A | A | A | A |
| Ex. 16 | A | A | A | A |
| Ex. 17 | A | B | B | B |
| Ex. 18 | A | B | B | B |
| Ex. 19 | A | B | A | A |
| Ex. 20 | A | C | A | A |
| Ex. 21 | B | A | C | C |
| Ex. 22 | B | B | C | C |
| Ex. 23 | B | C | A | A |
| Ex. 24 | B | C | A | A |
| Ex. 25 | B | A | B | B |
| Ex. 26 | A | A | B | B |
| Ex. 27 | B | C | A | A |
| Ex. 28 | A | C | A | A |
| Ex. 29 | A | A | C | C |
| Ex. 30 | A | B | B | B |
| Ex. 31 | A | B | A | A |
| Ex. 32 | A | B | A | A |

TABLE 5

| | Filming of silica | Low temperature fixing ability | Heat resistant storage stability | Transfer stability |
|---|---|---|---|---|
| Ex. 33 | A | B | B | B |
| Ex. 34 | A | B | B | B |
| Ex. 35 | A | C | A | A |
| Ex. 36 | A | C | A | A |
| Ex. 37 | B | B | C | C |
| Ex. 38 | B | C | C | B |
| Ex. 39 | B | C | A | A |
| Ex. 40 | B | C | A | A |
| Ex. 41 | B | B | B | B |
| Ex. 42 | A | B | B | B |
| Ex. 43 | B | C | A | A |
| Ex. 44 | A | C | A | A |
| Ex. 45 | A | B | C | C |

TABLE 5-continued

| | Filming of silica | Low temperature fixing ability | Heat resistant storage stability | Transfer stability |
|---|---|---|---|---|
| Ex. 46 | A | B | C | B |
| Ex. 47 | A | B | A | A |
| Ex. 48 | A | B | A | A |
| Ex. 49 | A | C | A | B |
| Ex. 50 | A | C | A | B |
| Ex. 51 | A | C | A | A |
| Ex. 52 | A | C | A | A |
| Ex. 53 | C | C | A | C |
| Ex. 54 | B | C | A | B |
| Ex. 55 | C | C | A | A |
| Ex. 56 | B | C | A | A |
| Ex. 57 | B | C | A | B |
| Ex. 58 | A | C | A | B |
| Ex. 59 | B | C | A | A |
| Ex. 60 | A | C | A | A |
| Ex. 61 | A | C | A | C |
| Ex. 62 | A | C | A | B |
| Ex. 63 | A | C | A | A |
| Ex. 64 | A | C | A | A |

TABLE 6

| | Filming of silica | Low temperature fixing ability | Heat resistant storage stability | Transfer stability |
|---|---|---|---|---|
| Comp. Ex. 1 | B | A | D | D |
| Comp. Ex. 2 | B | D | B | D |
| Comp. Ex. 3 | B | D | D | A |
| Comp. Ex. 4 | B | D | A | A |
| Comp. Ex. 5 | B | A | D | D |
| Comp. Ex. 6 | B | B | C | D |
| Comp. Ex. 7 | B | D | B | A |
| Comp. Ex. 8 | B | D | A | A |
| Comp. Ex. 9 | B | A | D | D |
| Comp. Ex. 10 | B | D | B | C |
| Comp. Ex. 11 | B | B | D | D |
| Comp. Ex. 12 | B | D | A | C |
| Comp. Ex. 13 | D | A | D | C |
| Comp. Ex. 14 | D | A | D | C |
| Comp. Ex. 15 | D | C | B | A |
| Comp. Ex. 16 | D | C | A | A |
| Comp. Ex. 17 | D | B | C | B |
| Comp. Ex. 18 | D | C | B | B |
| Comp. Ex. 19 | D | C | B | A |
| Comp. Ex. 20 | D | C | A | A |
| Comp. Ex. 21 | D | B | C | A |
| Comp. Ex. 22 | A | B | C | D |
| Comp. Ex. 23 | C | D | C | D |

The embodiments of the present invention are, for example, as follows:

<1> A toner, containing:

silica particles containing first silica particles, and second silica particles, wherein the toner is a toner produced by depositing the silica particles on surfaces of base particles, wherein the first silica particles have an average primary particle diameter of 75 nm to 250 nm, wherein the second silica particles have an average primary particle diameter of 10 nm to 50 nm, wherein a mass ratio of the first silica particles to the base particles is 0.010 to 0.040, wherein a mass ratio of the second silica particles to the base particles is 0.005 to 0.030, wherein a liberation ratio of the silica particles from the toner by a ultrasonic vibration method is 5% by mass to 20% by mass, and wherein an amount of particles having primary particle diameters of 30 nm or smaller in the silica particles librated from the toner by the ultrasonic vibration method is 20% by number or less.

<2> The toner according to <1>, wherein the amount of particles having primary particle diameters of 30 nm or smaller in the silica particles librated from the toner by the ultrasonic vibration method is 15% by number or less.

<3> The toner according to any of <1> or <2>, wherein the first silica particles have the average primary particle diameter of 120 nm to 200 nm.

<4> The toner according to any one of <1> to <3>, wherein the second silica particles have the average primary particle diameter of 20 nm to 40 nm.

<5> The toner according to any one of <1> to <4>, wherein the base particles are produced by granulating in an aqueous medium.

<6> The toner according to any one of <1> to <5>, wherein the base particles contain urea-modified polyester.

<7> The toner according to any one of <1> to <6>, wherein the base particles contain crystalline polyester, or non-crystalline polyester, or both thereof.

<8> A developer, containing the toner according to any one of <1> to <7>.

<9> An image forming apparatus, containing:

a photoconductor;

an electrostatic latent image forming unit configured to form an electrostatic latent image on the photoconductor;

a developing unit configured to develop the electrostatic latent image formed on the photoconductor with a toner, to thereby form a toner image;

a transferring unit configured to transfer the toner image formed on the photoconductor to a recording medium; and a fixing unit configured to fix the toner image transferred on the recording medium, wherein the toner is the toner according to any one of <1> to <7>.

This application claims priority to Japanese application No. 2013-020424, filed on Feb. 5, 2013 and incorporated herein by reference.

What is claimed is:

1. A toner, comprising:

toner base particles; and silica particles comprising first silica particles, and second silica particles, wherein the base particles comprise a crystalline polyester, wherein the first silica particles have an average primary particle diameter of 78 nm to 250 nm, wherein the second silica particles have an average primary particle diameter of 19 nm to 50 nm, wherein a mass ratio of the first silica particles to the base particles is 0.011 to 0.038, wherein a mass ratio of the second silica particles to the base particles is 0.006 to 0.028, wherein a liberation ratio of the silica particles from the toner by an ultrasonic vibration method is 5% by mass to 15% by mass, relative to the total mass of the silica on the toner base particles, and wherein an amount of particles having primary particle diameters of 30 nm or smaller in the silica particles liberated from the toner by the ultrasonic vibration method is 6% by number to 20% by number, relative to the total number of liberated silica particles from the toner.

2. The toner according to claim 1, wherein the amount of particles having primary particle diameters of 30 nm or smaller in the silica particles liberated from the toner by the ultrasonic vibration method is from 6% by number to 15% by number, relative to the total number of liberated silica particles from the toner.

3. The toner according to claim 1, wherein the first silica particles have the average primary particle diameter of 120 nm to 200 nm.

4. The toner according to claim 1, wherein the second silica particles have the average primary particle diameter of 20 nm to 40 nm.

5. The toner according to claim 1, wherein the base particles are produced by granulating in an aqueous medium.

6. The toner according to claim 1, wherein the base particles comprise a urea-modified polyester.

7. The toner according to claim 1, wherein the second silica particles have an average primary particle diameter of 40 nm to 50 nm.

8. The toner according to claim 1, wherein a mass ratio of the second silica particles to the base particles is 0.010 to 0.020.

9. A developer, comprising:

a toner according to claim 1; and a carrier.

10. The developer according to claim 9, wherein the amount of particles having primary particle diameters of 30 nm or smaller in the silica particles liberated from the toner by the ultrasonic vibration method is from 6% by number to 15% by number, relative to the total number of liberated silica particles from the toner.

11. The developer according to claim 9, wherein the first silica particles have the average primary particle diameter of 120 nm to 200 nm.

12. The developer according to claim 9, wherein the second silica particles have the average primary particle diameter of 20 nm to 40 nm.

13. The developer according to claim 9, wherein the base particles are produced by granulating in an aqueous medium.

14. The developer according to claim 9, wherein the base particles comprise a urea-modified polyester.

* * * * *